US009116458B2

(12) United States Patent
Shirai et al.

(10) Patent No.: US 9,116,458 B2
(45) Date of Patent: Aug. 25, 2015

(54) LIGHT SCANNING DEVICE AND IMAGE FORMING APPARATUS

(71) Applicant: Sharp Kabushiki Kaisha, Osaka (JP)

(72) Inventors: Nobuhiro Shirai, Osaka (JP); Takaharu Motoyama, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 14/267,223

(22) Filed: May 1, 2014

(65) Prior Publication Data

US 2015/0002593 A1 Jan. 1, 2015

(30) Foreign Application Priority Data

Jun. 27, 2013 (JP) ..... 2013-135262

(51) Int. Cl.
*G03G 15/04* (2006.01)

(52) U.S. Cl.
CPC ..... *G03G 15/04072* (2013.01)

(58) Field of Classification Search
CPC ..... G03G 15/04036; G03G 15/04072; G02B 26/08
USPC ..... 347/243, 256–262
See application file for complete search history.

(56) References Cited

U.S. PATENT DOCUMENTS

| | | | | |
|---|---|---|---|---|
| 7,251,067 | B2 * | 7/2007 | Kudo | 359/205.1 |
| 8,675,036 | B2 * | 3/2014 | Nishiguchi | 347/259 |
| 2002/0041419 | A1 | 4/2002 | Takada et al. | |
| 2005/0254110 | A1 | 11/2005 | Inagaki | |
| 2010/0067080 | A1 * | 3/2010 | Shimizu et al. | 359/205.1 |

FOREIGN PATENT DOCUMENTS

| | | | |
|---|---|---|---|
| JP | 2001-337285 | A | 12/2001 |
| JP | 2002-311360 | | 10/2002 |
| JP | 2005-326744 | A | 11/2005 |
| JP | 2010-072184 | A | 4/2010 |

* cited by examiner

*Primary Examiner* — Sarah Al Hashimi
(74) *Attorney, Agent, or Firm* — Renner, Otto, Boisselle & Sklar, LLP

(57) ABSTRACT

A light scanning device of the invention includes a scan deflection range of each of the light fluxes deflected by the deflecting part in a scan period of the scan object with the respective light fluxes is divided into a first deflection range where a reflection angle of each of the light fluxes with respect to the deflecting part is small and a second deflection range where the reflection angle is large. A polarization direction of each of the light fluxes is set such that a reflectivity of the reflective mirror when each of the light fluxes deflected in the second deflection range is reflected becomes larger than a reflectivity of the reflective mirror when each of the light fluxes deflected in the first deflection range is reflected.

12 Claims, 12 Drawing Sheets

FIG.11

| | | A | B |
|---|---|---|---|
| (I) ROTATION POSITION OF SECOND SEMICONDUCTOR LASER 45b | | 81, 82, 83, J, Z, Y | 81, 82, 83, F1, J, Z, Y |
| (II) REFLECTING SURFACE OF POLYGONAL MIRROR | | J, 92a, α2, α1, 42, Z, Y | J, 92a, α2, α1, 42, Z, Y |
| (III) REFLECTION OF POLYGONAL MIRROR | P POLARIZED COMPONENT | 0 | α2 SIDE = α1 SIDE |
| | S POLARIZED COMPONENT | α2 SIDE = α1 SIDE | α2 SIDE = α1 SIDE |
| | ANGLE OF INCIDENCE, REFLECTION ANGLE | α2 SIDE > α1 SIDE | α2 SIDE > α1 SIDE |
| (IV) REFLECTANCE DISTRIBUTION | | REFLECTIVITY, α2, Q, α1 | REFLECTIVITY, α2, Q, α1 |
| (V) REFLECTING SURFACE OF REFLECTIVE MIRROR 66a | | 92b, J, α2, α1, 66a; 92b, J, Q, 66a; 92b, J, Z, X, 66a | 92b, J, α2, α1, 66a; 92b, 66a, Q, J; 92b, 66a, J |
| (VI) REFLECTION OF REFLECTIVE MIRROR 66a | P POLARIZED COMPONENT | α2 SIDE = α1 SIDE | α2 SIDE < α1 SIDE |
| | S POLARIZED COMPONENT | α2 SIDE = α1 SIDE | α2 SIDE > α1 SIDE |
| | ANGLE OF INCIDENCE, REFLECTION ANGLE | α2 SIDE = α1 SIDE | α2 SIDE = α1 SIDE |
| (VII) REFLECTANCE DISTRIBUTION | | REFLECTIVITY, α2, Q, α1 | REFLECTIVITY, α2, Q, α1 |
| (VIII) INCIDENT LIGHT QUANTITY DISTRIBUTION AT PHOTOSENSITIVE DRUM | | INCIDENT LIGHT QUANTITY DISTRIBUTION, α2, Q, α1 | INCIDENT LIGHT QUANTITY DISTRIBUTION, α2, Q, α1 |

FIG.12

| | | |
|---|---|---|
| (I) ROTATION POSITION OF SECOND SEMICONDUCTOR LASER 45b | | 81, 82, 83, F2, J, Z, Y |
| (II) REFLECTING SURFACE OF POLYGONAL MIRROR | | J, 92a, α2, α1, 42, Z, Y |
| (III) REFLECTION OF POLYGONAL MIRROR | P POLARIZED COMPONENT | α2 SIDE = α1 SIDE |
| | S POLARIZED COMPONENT | α2 SIDE = α1 SIDE |
| | ANGLE OF INCIDENCE, REFLECTION ANGLE | α2 SIDE > α1 SIDE |
| (IV) REFLECTANCE DISTRIBUTION | | REFLECTIVITY, α2, Q, α1 |
| (V) REFLECTING SURFACE OF REFLECTIVE MIRROR 66a | | J, 92b, Z, X, α2, α1, 66a; J, 92b, 66a, Q; J, 92b, 66a |
| (VI) REFLECTION OF REFLECTIVE MIRROR 66a | P POLARIZED COMPONENT | α2 SIDE > α1 SIDE |
| | S POLARIZED COMPONENT | α2 SIDE < α1 SIDE |
| | ANGLE OF INCIDENCE, REFLECTION ANGLE | α2 SIDE = α1 SIDE |
| (VII) REFLECTANCE DISTRIBUTION | | REFLECTIVITY, α2, Q, α1 |
| (VIII) INCIDENT LIGHT QUANTITY DISTRIBUTION AT PHOTOSENSITIVE DRUM | | INCIDENT LIGHT QUANTITY DISTRIBUTION, α2, Q, α1 |

FIG.13

| | | |
|---|---|---|
| (I) ROTATION POSITION OF FIRST SEMICONDUCTOR LASER 44a | | 81, 82, 83, F2, J, Z, Y |
| (II) REFLECTING SURFACE OF POLYGONAL MIRROR | | J, 92a, α2, α1, 42, Z, Y |
| (III) REFLECTION OF POLYGONAL MIRROR | P POLARIZED COMPONENT | α1 SIDE = α2 SIDE |
| | S POLARIZED COMPONENT | α1 SIDE = α2 SIDE |
| | ANGLE OF INCIDENCE, REFLECTION ANGLE | α1 SIDE < α2 SIDE |
| (IV) REFLECTANCE DISTRIBUTION | | REFLECTIVITY, α1, Q, α2 |
| (V) REFLECTING SURFACE OF REFLECTIVE MIRROR 64a | | 92b, J, Z, X, α1, 64a, α2; J, 92b, 64a, Q; J, 92b, 64a |
| (VI) REFLECTION OF REFLECTIVE MIRROR 64a | P POLARIZED COMPONENT | α1 SIDE > α2 SIDE |
| | S POLARIZED COMPONENT | α1 SIDE < α2 SIDE |
| | ANGLE OF INCIDENCE, REFLECTION ANGLE | α1 SIDE = α2 SIDE |
| (VII) REFLECTANCE DISTRIBUTION | | REFLECTIVITY, α1, Q, α2 |
| (VIII) INCIDENT LIGHT QUANTITY DISTRIBUTION AT PHOTOSENSITIVE DRUM | | INCIDENT LIGHT QUANTITY DISTRIBUTION, α1, Q, α2 |

LIGHT SCANNING DEVICE AND IMAGE FORMING APPARATUS

TECHNICAL FIELD

The present invention relates to a light scanning device that scans a scan object with light flux and an image forming apparatus with the light scanning device.

BACKGROUND ART

For example, an image forming apparatus using electrophotographic system uniformly charges a photosensitive body surface (a scan object), scans the photosensitive body surface with light flux, and forms an electrostatic latent image at the photosensitive body surface. Then, the image forming apparatus develops the electrostatic latent image on the photosensitive body surface with toner to form a toner image on the photosensitive body surface, and transfers the toner image from the photosensitive body to a recording paper sheet.

A light scanning device scans the photosensitive body surface with light flux. This light scanning device includes a light-emitting element such as a semiconductor laser, a polygonal mirror, a plurality of reflective mirrors, and a plurality of lenses such as an fθ lenses. The light-emitting element emits a light flux. The polygonal mirror and the plurality of reflective mirrors reflect the light flux. The plurality of lenses deflect the light flux. The light flux from the semiconductor laser is guided to the photosensitive body surface by an optical member such as the polygonal mirror, the reflective mirror, and the respective lenses. The photosensitive body surface is scanned with the light flux, thus an electrostatic latent image is formed on the photosensitive body surface.

With such light scanning device, if a light flux emitted from the light-emitting element is linearly polarized light, the light flux may contain many P polarized components with respect to the reflecting surfaces of the polygonal mirror and the reflective mirror, reflectivity of P polarization significantly changes according to an angle of incidence and a reflection angle of the light flux with respect to the reflecting surface. Accordingly, incident light quantity distribution of light flux at the photosensitive body surface may be unbalanced.

In the case where a light-emitting element with a plurality of light-emitting points that emits the respective light fluxes in linear polarization, a light-emitting element that emits a so-called multibeam, is used, rotation of the light-emitting element adjusts incident intervals of the respective light fluxes on the photosensitive body surface. However, the rotation of the light-emitting element changes a polarization direction (a vibrating direction of electric field) of the respective light fluxes in linear polarization. This may increases a ratio of the P polarized components of the respective light fluxes with respect to the reflecting surfaces of the polygonal mirror and the reflective mirror. This further increase unbalance of incident light quantity distributions of the respective light fluxes at the photosensitive body surface.

For example, Patent Literature 1 employs a light-emitting element that emits multibeam. Rotation of the light-emitting element changes polarization directions of the respective light fluxes in linear polarization and changes a ratio of S polarized component to P polarized components of the respective luminous fluxes via a surface of optical member. This adjusts the luminescence level of the respective light fluxes.

However, even here, this simply rotates the light-emitting element. Accordingly, the polarization direction of the light flux in linear polarization changes, and the ratio of the P polarized component of light flux with respect to the surface of the optical member may be increased. This cause incident light quantity distribution of light flux at the photosensitive body surface to be more unbalanced.

CITATION LIST

Patent Literature

PATENT LITERATURE 1: Japanese Unexamined Patent Application Publication No. 2002-311360

SUMMARY OF INVENTION

Technical Problem

Thus, if the light flux emitted from the light-emitting element is in linear polarization, reflectivity of P polarization is significantly changed corresponding to the angle of incidence and the reflection angle of the light flux with respect to reflecting surfaces of a polygonal mirror and a reflective mirror. Accordingly, the incident light quantity distribution of light flux at the photosensitive body surface may be unbalanced.

If the incident intervals of the respective light fluxes on the photosensitive body surface are adjusted by rotating the light-emitting element that emits multibeam, or as described in Patent Literature 1, if the polarization direction of the light flux in linear polarization is intentionally changed by rotating the light-emitting element, the P polarized component of light flux with respect to the reflecting surfaces of the polygonal mirror and the reflective mirror may be increased. This further largely changes reflectivity of each of the light fluxes. This further increase unbalance of incident light quantity distribution of light flux at the photosensitive body surface.

On the other hand, such unbalance of the incident light quantity distribution of light flux at the photosensitive body surface can be corrected by controlling the light-emitting element. Alternatively, a glass sheet through which light flux transmits is disposed, and transmittance of the glass sheet is changed according to the position of the light flux in a scan direction. However, the control and the glass sheet make a structure of light scanning device complicated and increase the cost.

The present invention has been made to solve the above-described conventional problems, and it is an object of the present invention to provide a light scanning device and an image forming apparatus that allow reducing unbalance of incident light quantity distribution of light flux at a scan object surface even if a light-emitting element that emits a light flux including linear polarization is rotated.

Solutions to the Problems

To solve the above-described problems, a light scanning device of the present invention includes a light-emitting element, a deflecting part, and a reflective mirror. The light-emitting element includes a plurality of light-emitting points. Respective light fluxes are emitted from the plurality of light-emitting points. The deflecting part is configured to reflect to deflect the respective light fluxes. The reflective mirror is configured to reflect the respective light fluxes reflected to be deflected by the deflecting part. The light scanning device is configured to scan a scan object with the respective light fluxes passing through the deflecting part and the reflective mirror. A scan deflection range of each of the light fluxes deflected by the deflecting part in a scan period of the scan object with the respective light fluxes is divided into a first deflection range where a reflection angle of each of the light fluxes with respect to the deflecting part is small and a second deflection range where the reflection angle is large. A polarization direction of each of the light fluxes is set such that a reflectivity of the reflective mirror when each of the light fluxes deflected in the second deflection range is reflected becomes larger than a reflectivity of the reflective mirror when each of the light fluxes deflected in the first deflection range is reflected.

With the light scanning device of the present invention, assume that an incident surface (a surface perpendicular to the reflecting surface) including a light flux that enters and is reflected by the deflecting part and the reflecting surface of the reflective mirror is defined. In the case where the polarization direction of the light flux is vertical to the incident surface, the light flux becomes to have an S polarized component only with respect to the deflecting part and the reflecting surface of the reflective mirror. In the case where the polarization direction of the light flux is inclined with respect to the incident surface, the light flux includes the S polarized component and a P polarized component with respect to the deflecting part and the reflecting surface of the reflective mirror. Reflectivity of S polarization is approximately uniform regardless of an angle of incidence and a reflection angle of the light flux with respect to the reflecting surface. Reflectivity of P polarization largely changes according to the angle of incidence and the reflection angle of the light flux with respect to the reflecting surface.

The reflection angles of the respective light fluxes with respect to the deflecting part become small in the first deflection range. The reflection angles of the respective light fluxes with respect to the deflecting part become large in the second deflection range. In view of this, in the case where the light flux includes the S polarized component and the P polarized component with respect to the incident surface perpendicular to the reflecting surface of the deflecting part, the reflectivities of P polarization of the respective light fluxes become large in the first deflection range where the reflection angle is small, and become small in the second deflection range where the reflection angle is large. The reflectivities of S polarization of the respective light fluxes are approximately uniform in both the first and the second deflection ranges. Therefore, the reflectivities of the respective light fluxes at the deflecting part become large in the first deflection range and become small in the second deflection range.

On the other hand, with the light scanning device of the present invention, the polarization directions of the respective light fluxes are set such that the reflectivity of the reflective mirror when each of the light fluxes deflected in the second deflection range is reflected becomes larger than the reflectivity of the reflective mirror when each of the light fluxes deflected in the first deflection range is reflected. Therefore, the reflectivity of each of the light fluxes at the reflective mirror becomes small in the first deflection range and becomes large in the second deflection range.

Consequently, unbalance of the reflectance distribution at the deflecting part and unbalance of the reflectance distribution at the reflective mirror are cancelled one another. Thus, the incident light quantity distributions of the respective light fluxes at the scan object surface become approximately uniform.

The light scanning device of the present invention includes a first light-emitting element and a second light-emitting element, a deflecting part, and respective reflective mirrors. The first light-emitting element and the second light-emitting element include a plurality of light-emitting points. Respective light fluxes are emitted from the plurality of light-emitting points. The deflecting part is configured to reflect to deflect the respective light fluxes emitted from the first light-emitting element and the second light-emitting element. The respective reflective mirrors are configured to reflect the respective light fluxes reflected to be deflected by the deflecting part. The first light-emitting element and one of the respective reflective mirrors, and the second light-emitting element and another of the respective reflective mirrors are divided to both sides of an imaginary arrangement center line passing through a rotation axis of the deflecting part, and the light scanning device is configured to scan a scan object with the respective light fluxes passing through the deflecting part and the respective reflective mirrors. A scan deflection range of each of the light fluxes deflected by the deflecting part in a scan period of the scan object with the respective light fluxes is divided into a first deflection range where a reflection angle of each of the light fluxes with respect to the deflecting part is small and a second deflection range where the reflection angle is large for each of the reflective mirrors separately. A polarization direction of each of the light fluxes emitted from the first light-emitting element and a polarization direction of each of the light fluxes emitted from the second light-emitting element are set to be symmetrical to one another with respect to a rotation axis of the deflecting part such that a reflectivity of the reflective mirror when each of the light fluxes deflected in the second deflection range is reflected becomes larger than a reflectivity of the reflective mirror when each of the light fluxes deflected in the first deflection range is reflected in any of the respective reflective mirrors.

With this light scanning device of the present invention, the first light-emitting element and one of the respective reflective mirrors, and the second light-emitting element and the other of the respective reflective mirrors are symmetrically disposed with respect to the imaginary arrangement center line passing through the rotation axis of the deflecting part. Accordingly, in any of the respective reflective mirrors, the polarization directions of the respective light flux are set by rotation of the first and the second light-emitting elements such that the reflectivity of the reflective mirror when each of the light fluxes deflected in the second deflection range is reflected becomes larger than the reflectivity of the reflective mirror when each of the light fluxes deflected in the first deflection range is reflected. Then, the polarization directions of the respective light fluxes from the first light-emitting element and the polarization directions of the respective light fluxes from the second light-emitting element become symmetrical to one another with respect to the rotation axis of the deflecting part.

For example, the polarization direction of each of the light fluxes emitted from the first light-emitting element and the polarization direction of each of the light fluxes emitted from the second light-emitting element are inclined to reverse directions to one another with respect to the rotation axis of the deflecting part.

With the light scanning device of the present invention, the light flux that enters the reflective mirror and the light flux reflected by the reflective mirror form an obtuse angle.

In this case, since the reflectivity of the reflective mirror is more largely reduced when the respective light fluxes are reflected, thus application of the present invention becomes more effective.

With the light scanning device of the present invention, the light fluxes at respective light-emitting points of the light-emitting element have a same polarization direction. Further, a rotation of the light-emitting element inclines an arranging direction of the respective light-emitting points at the light-emitting element with respect to the rotation axis of the deflecting part. This inclination sets an incident interval of the light fluxes from the respective light-emitting points on the scan object.

Alternatively, with the light scanning device of the present invention, the light fluxes of the first light-emitting element at the respective light-emitting points have a same polarization direction, and the light fluxes of the second light-emitting element at respective light-emitting points have a same polarization direction. Further, a rotation of at least one of the first and the second light-emitting elements inclines an arranging direction of the respective light-emitting points of the at least one with respect to the rotation axis of the deflecting part. This inclination sets an incident interval of the light fluxes from the respective light-emitting points of the at least one on the scan object.

For example, the incident interval of the light fluxes from the respective light-emitting points is an interval in a direction perpendicular to the polarization direction of the respective light fluxes on the scan object.

When a light-emitting element with a plurality of light-emitting points from which the respective light fluxes are emitted is employed, a rotation of the light-emitting element adjusts an incident interval of the respective light fluxes on the scan object. Accordingly, even if the light-emitting element is rotated, application of the present invention where the incident light quantity distributions of the respective light fluxes at the scan object surface are almost uniform is effective.

With the light scanning device of the present invention, a reflection angle of the light flux with respect to the reflective mirror is more than 45° and less than 90°.

In this case, since the reflectivity of the reflective mirror is more largely reduced when the respective light fluxes are reflected, thus application of the present invention becomes more effective.

Further, with the light scanning device of the present invention, a reflection angle of each of the light fluxes with respect to the deflecting part varies in a range of 10° to 60°.

In this case, the reflectivity of the deflecting part varies according to a change in the reflection angle of each of the light fluxes with respect to the deflecting part.

With the light scanning device of the present invention, the first light-emitting element and the second light-emitting element are disposed by two for each. The first light-emitting element and the second light-emitting element are disposed at respective apexes of a trapezoid or a rectangle on a plane perpendicular to emission direction of light flux of the respective first light-emitting element and emission direction of light flux of the respective second light-emitting element.

This allows downsizing of the light scanning device.

Further, with the light scanning device of the present invention, a reflectivity of the deflecting part when each of the light fluxes is reflected to the second deflection range is smaller than a reflectivity of the deflecting part when each of the light fluxes is reflected to the first deflection range.

In this case, unbalance of the reflectance distribution at the deflecting part and unbalance of the reflectance distribution at the reflective mirror are cancelled one another. Thus, the incident light quantity distributions of the respective light fluxes at the scan object surface become almost uniform.

On the other hand, an image forming apparatus of the present invention includes the light scanning device of the above-described present invention. The light scanning device forms a latent image on a scan object. The latent image on the scan object is developed into a visible image. The visible image is transferred from the scan object to be formed on a paper sheet.

The image forming apparatus of the present invention can also provide similar advantageous effects to those of the light scanning device according to the present invention.

Advantageous Effects of Invention

According to the present invention, the reflection angles of the respective light fluxes with respect to the deflecting part become small in the first deflection range. The reflection angles of the respective light fluxes with respect to the deflecting part become large in the second deflection range. In view of this, in the case where the light flux includes the S polarized component and the P polarized component with respect to the incident surface perpendicular to the reflecting surface of the deflecting part, the reflectivities of P polarization of the respective light fluxes becomes large in the first deflection range where the reflection angle is small, and becomes small in the second deflection range where the reflection angle is large. The reflectivities of S polarization of the respective light fluxes are approximately uniform in both the first and the second deflection ranges. Therefore, the reflectivities of the respective light fluxes at the deflecting part become large in the first deflection range and become small in the second deflection range.

On the other hand, with the light scanning device of the present invention, the polarization directions of the respective light fluxes are set by rotation of the light-emitting element such that the reflectivity of the reflective mirror when each of the light fluxes deflected in the second deflection range is reflected becomes larger than the reflectivity of the reflective mirror when each of the light fluxes deflected in the first deflection range is reflected. Therefore, the reflectivities of the respective light fluxes at the reflective mirror become small in the first deflection range and become large in the second deflection range.

Consequently, unbalance of the reflectance distribution at the deflecting part and unbalance of the reflectance distribution at the reflective mirror are cancelled one another. Thus, the incident light quantity distributions of the respective light fluxes at the scan object surface become approximately uniform.

BRIEF DESCRIPTION OF THE DRAWINGS

FIG. 11 is a diagram illustrating rotation positions of a light-emitting surface of semiconductor laser, polarization directions of light fluxes, a reflecting surface of polygonal mirror, reflectance distributions at the reflecting surface of the polygonal mirror, a reflecting surface of a reflective mirror, reflectance distributions at the reflecting surface of the reflective mirror, incident light quantity distributions at a surface of photosensitive drum, and similar items of the first embodiment.

FIG. 12 is a diagram listing items similar to FIG. 11 in the case where the rotation direction of the semiconductor laser is inverted.

FIG. 13 is a diagram listing items similar to FIG. 11 with another semiconductor laser of a second embodiment.

DESCRIPTION OF EMBODIMENTS

Hereinafter, embodiments of the present invention will be described based on the accompanying drawings.

Figure 1:
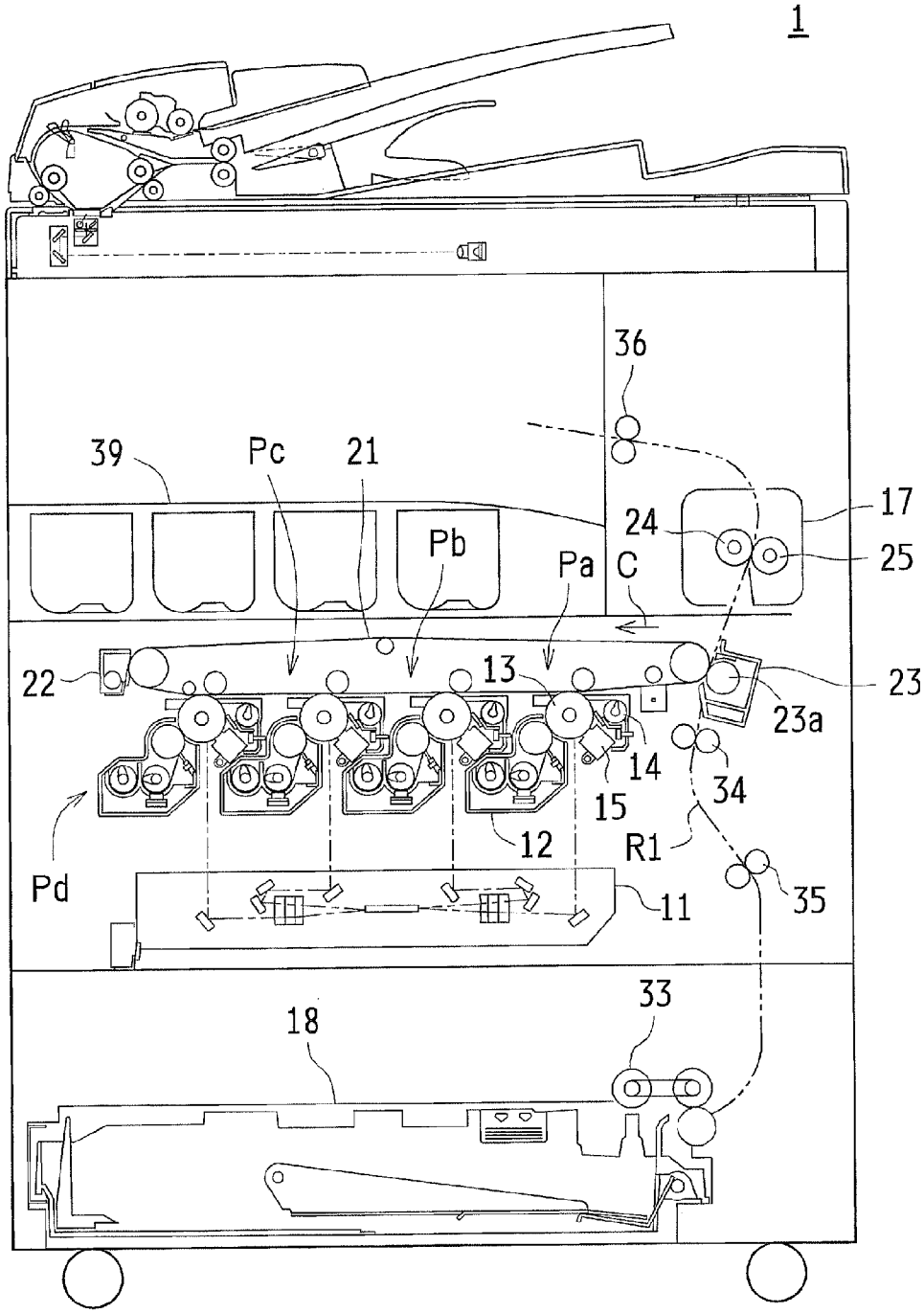
FIG. 1 is a cross-sectional view illustrating an image forming apparatus with a light scanning device of the present invention.

FIG. 1 is a cross-sectional view illustrating an image forming apparatus with a light scanning device of the present invention. An image forming apparatus 1 prints a color image using respective colors of black (K), cyan (C), magenta (M), and yellow (Y); or a monochrome image using a single color (for example, black) on a recording paper sheet. In view of this, developing equipment 12, a photosensitive drum 13, a drum cleaning apparatus 14, a charging apparatus 15, and a similar apparatus are disposed for each of four to form four types of toner images according to the respective colors. Each apparatus corresponds to black, cyan, magenta, and yellow. Thus, four image stations Pa, Pb, Pc, and Pd are constituted.

The drum cleaning apparatuses 14 remove and recover residual toner at the surfaces of the photosensitive drums 13 of all of the respective image stations Pa, Pb, Pc, and Pd. Then, the charging apparatuses 15 uniformly charge the surfaces of the photosensitive drums 13 at a predetermined electric potential. A light scanning device 11 exposes the surfaces of the photosensitive drums 13 to form electrostatic latent images at the surfaces. Then, the developing equipment 12 develops the electrostatic latent images on the surfaces of the photosensitive drums 13 and form toner images at the surfaces of the photosensitive drums 13. Thus, a toner image with each color is formed at the surface of the photosensitive drum 13.

Subsequently, while an intermediate transfer belt 21 is moved around the arrow direction C, a belt cleaning apparatus 22 removes and recovers residual toner at the intermediate transfer belt 21. Then, toner image with each color at the surface of the photosensitive drum 13 is sequentially transferred and superimposed to the intermediate transfer belt 21, thus a color toner image is formed on the intermediate transfer belt 21.

A nip region is formed between the intermediate transfer belt 21 and a transfer roller 23*a* of a secondary transfer apparatus 23. The recording paper sheet conveyed through an S-shaped paper sheet transport path R1 is conveyed while being sandwiched by the nip region. The color toner image on the surface of the intermediate transfer belt 21 is transferred on the recording paper sheet. Then, the recording paper sheet is sandwiched between a heating roller 24 and a pressing roller 25 of a fixing apparatus 17, and heated and pressurized for fixing the color toner image on the recording paper sheet.

On the other hand, a pickup roller 33 extracts the recording paper sheets from a sheet feed cassette 18. The recording paper sheets are conveyed through the paper sheet transport path R1, pass through the secondary transfer apparatus 23 and the fixing apparatus 17, and then are transported to a discharge tray 39 via a discharge roller 36. This paper sheet transport path R1 includes a registration roller 34, a conveyance roller 35, or a similar part. The registration roller 34 starts conveying the recording paper sheets matching transfer timing of the toner image at the nip region between the intermediate transfer belt 21 and the transfer roller 23*a* after the recording paper sheets are once stopped and the top of the recording paper sheets are aligned. The conveyance roller 35 promotes conveyance of the recording paper sheets.

Figure 2:
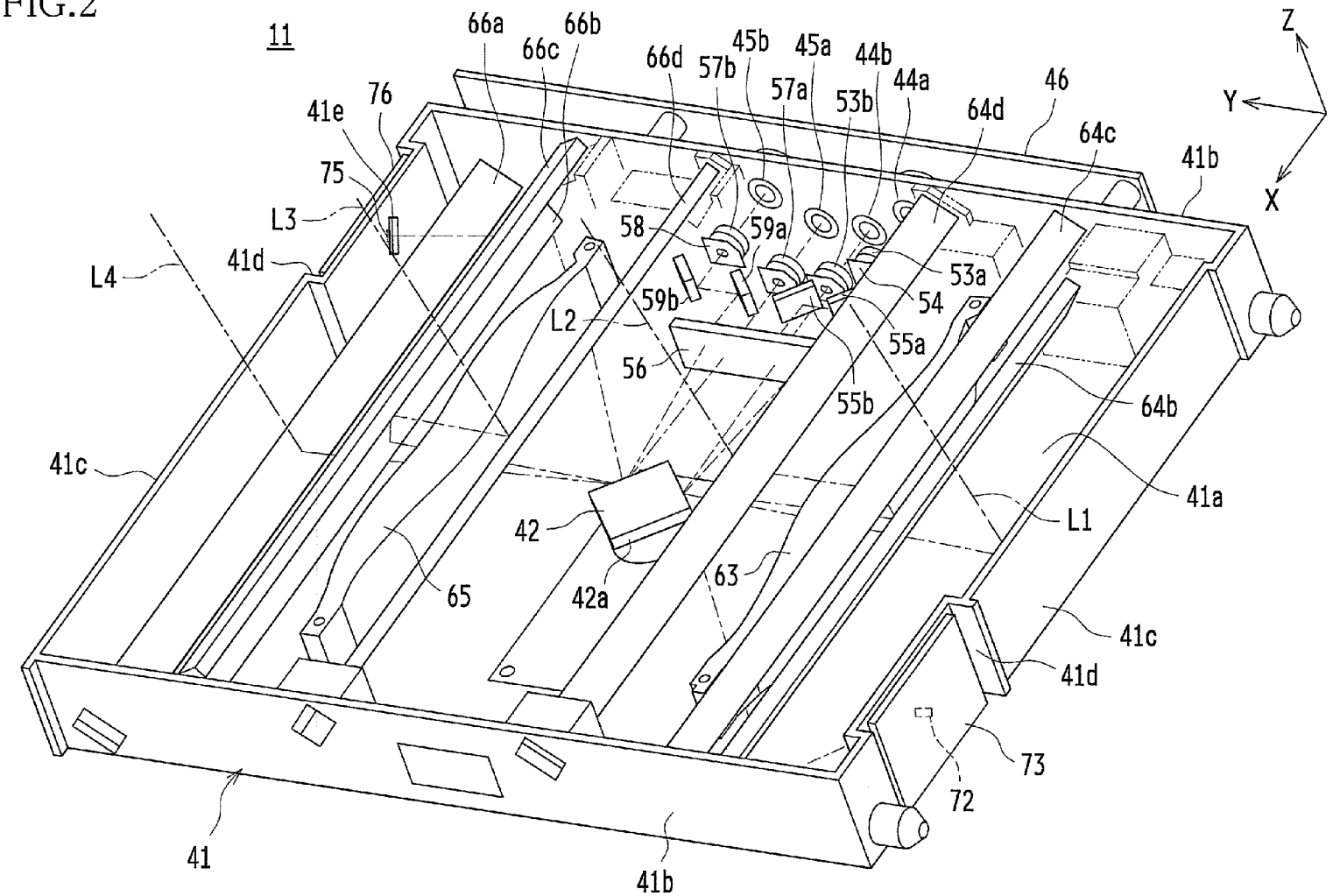
FIG. 2 is a perspective view illustrating an inside of a housing of the light scanning device viewed from obliquely upward and illustrating a state with an upper lid removed.
Figure 3:
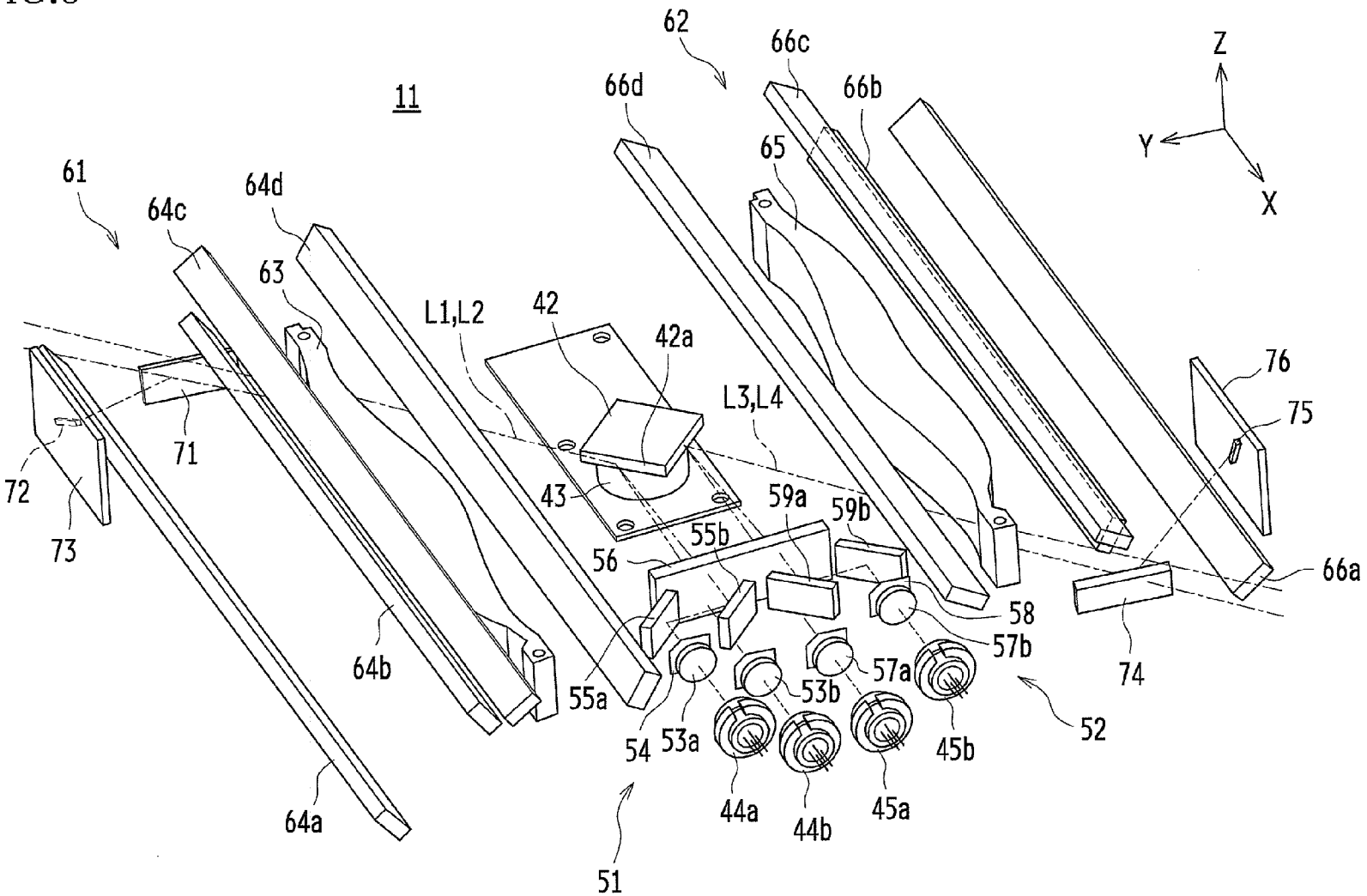
FIG. 3 is a perspective view illustrating a plurality of extracted optical members of the light scanning device and illustrating a state viewed from a back surface side of FIG. 2.
Figure 4:
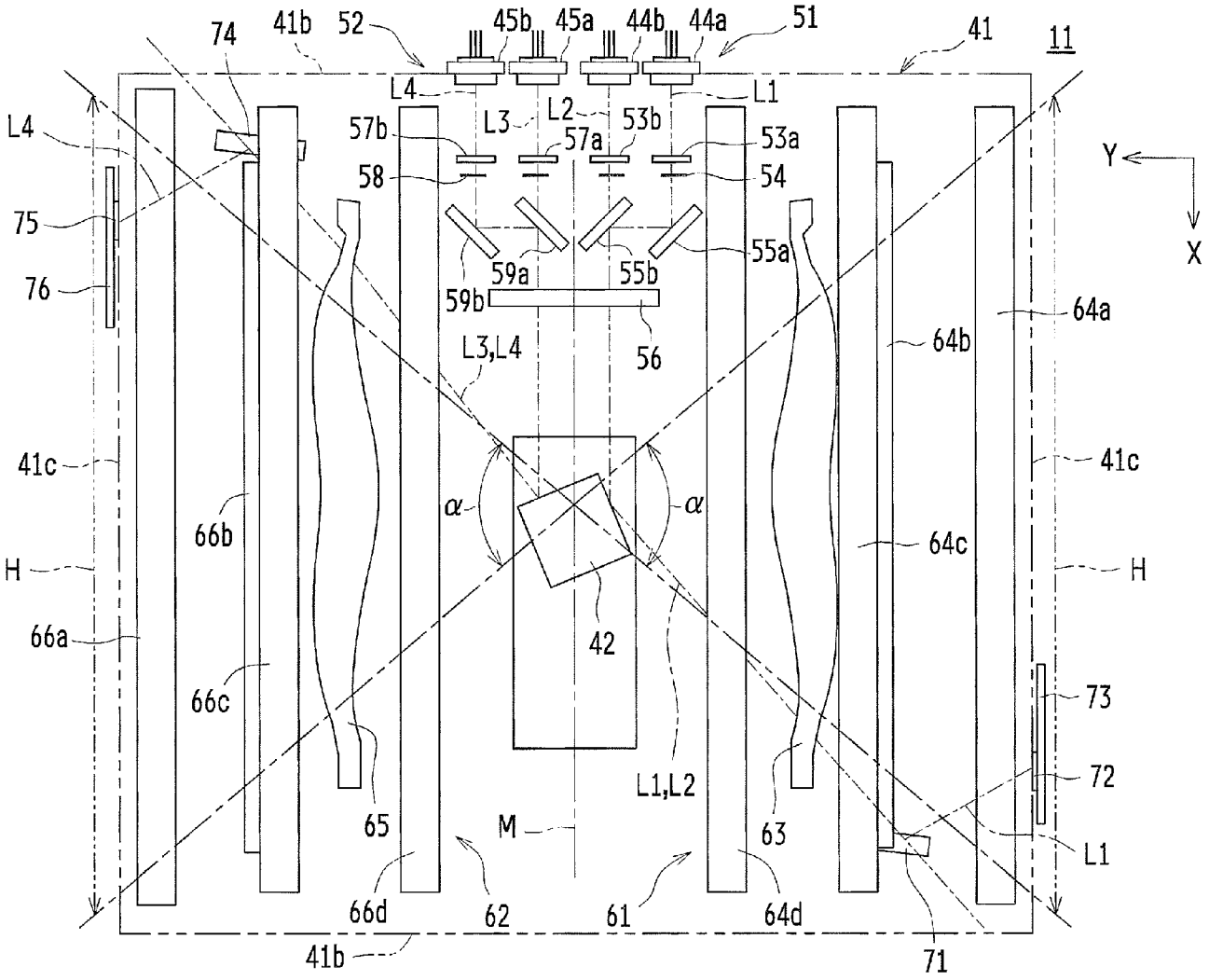
FIG. 4 is a plan view illustrating the plurality of extracted optical members of light scanning device.
Figure 5:
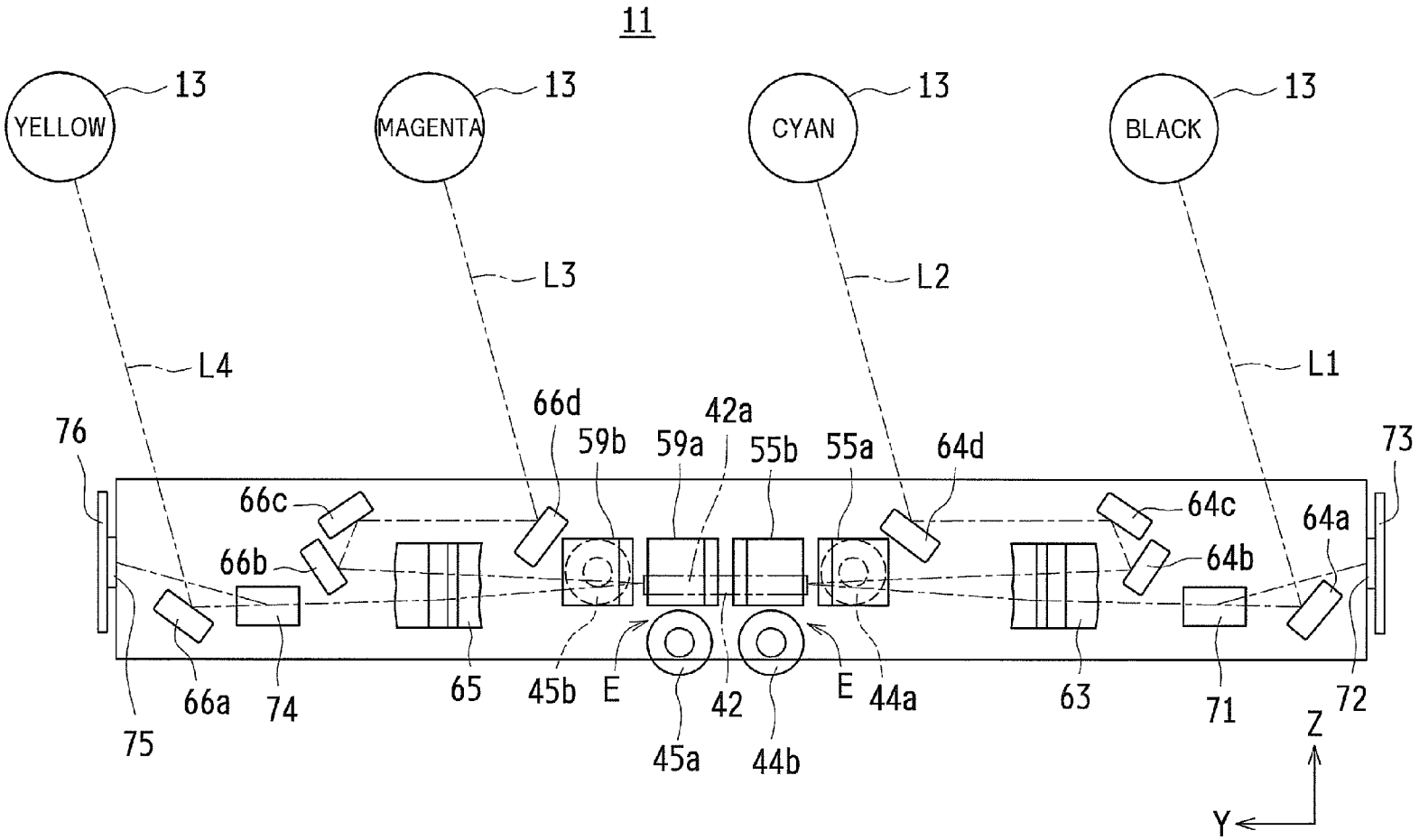
FIG. 5 is a side view illustrating the plurality of extracted optical members of light scanning device.

Next, the constitution of the light scanning device 11 will be described in detail using FIG. 2 to FIG. 5. FIG. 2 is a perspective view illustrating an inside of a housing 41 of the light scanning device 11 of FIG. 1 viewed from obliquely upward and illustrating a state with an upper lid removed. FIG. 3 is a perspective view illustrating a plurality of extracted optical members of the light scanning device 11 and illustrating a state viewed from a back surface side of FIG. 2. Further, FIG. 4 and FIG. 5 are a plan view and a side view illustrating the plurality of extracted optical members of the light scanning device 11. FIG. 5 also illustrates the respective photosensitive drums 13 disposed outside of the light scanning device 11.

The housing 41 includes a rectangular bottom plate 41*a* and four side plates 41*b* and 41*c* that surround the bottom plate 41*a*. A polygonal mirror 42, which has a square shape in plan view, is disposed at approximately center of the bottom plate 41*a*. A polygonal motor 43 is secured at approximately center of the bottom plate 41*a*. A rotational center of the polygonal mirror 42 is coupled to and secured to a rotation axis of the polygonal motor 43, and the polygonal motor 43 rotates the polygonal mirror 42.

A drive substrate 46 is secured to the outside of one side plate 41*b* of the housing 41. The drive substrate 46 includes two first semiconductor lasers 44*a* and 44*b* and two second semiconductor lasers 45*a* and 45*b* (total of four semiconductor lasers). The respective first semiconductor lasers 44*a* and 44*b* and the respective second semiconductor lasers 45*a* and 45*b* go into the inside of the housing 41 through respective holes formed at the side plate 41*b*.

Assuming that an imaginary arrangement center line M extends in a main-scanning direction X passing through the rotational center of the polygonal mirror 42, each of the first semiconductor lasers 44*a* and 44*b* is disposed symmetry to the respective second semiconductor lasers 45*a* and 45*b* placing the imaginary arrangement center line M as the center. A direction perpendicular to the main-scanning direction X is set as a sub-scanning direction Y. A direction perpendicular to the main-scanning direction X and the sub-scanning direction Y (the longitudinal direction of the rotation axis of the polygonal motor 43) is set as a height direction Z.

The drive substrate 46 is a plane plate-shaped printed circuit board and includes circuits for driving the respective first semiconductor lasers 44*a* and 44*b* and the respective second semiconductor lasers 45*a* and 45*b*. The respective first semiconductor lasers 44*a* and 44*b* and the respective second semiconductor lasers 45*a* and 45*b* are disposed on an approximately the same plane (YZ plane) by being mounted on the plane plate-shaped printed circuit board. The first semiconductor lasers 44*a* and 44*b* and the second semiconductor lasers 45*a* and 45*b* emit light fluxes L1 to L4, respectively. The respective light fluxes L1 to L4 are emitted in the vertical direction (the main-scanning direction X) with respect to the plane and to the inside of the housing 41.

In FIG. 2 to FIG. 5, the respective light fluxes L1 to L4 are illustrated with an alternate long and short dash line. However, two light fluxes (multibeam) in linear polarization are emitted from each of the first semiconductor lasers 44*a* and 44*b* and each of the second semiconductor lasers 45*a* and 45*b*. Accordingly, the two light fluxes parallel to the alternate long and short dash line are present separately from the respective alternate long and short dash lines indicating the respective light fluxes L1 to L4.

On the drive substrate 46 (YZ plane), the respective first semiconductor lasers 44*a* and 44*b* are disposed at different positions from one another in the sub-scanning direction Y and the height direction Z. Similarly, the respective second semiconductor lasers 45*a* and 45*b* are also disposed different positions from one another in the sub-scanning direction Y and the height direction Z.

The light scanning device 11 includes a first incident optical system 51 and a second incident optical system 52. The first incident optical system 51 guides the light fluxes L1 and L2 of the respective first semiconductor lasers 44*a* and 44*b* to the polygonal mirror 42. The second incident optical system 52 guides the light fluxes L3 and L4 of the respective second semiconductor lasers 45*a* and 45*b* to the polygonal mirror 42. The first incident optical system 51 includes two collimator lenses 53*a* and 53*b*, two apertures 54, two mirrors 55*a* and 55*b*, a cylindrical lens 56, and a similar component. The mirrors 55*a* and 55*b* are disposed at the same height as the first semiconductor laser 44*a*. Similarly, the second incident optical system 52 includes two collimator lenses 57*a* and 57*b*, two apertures 58, two mirrors 59*a* and 59*b*, the cylindrical lens 56, and a similar component. The mirrors 59*a* and 59*b* are disposed at the same height as the second semiconductor laser 45*b*. The respective collimator lens 53*a* and 53*b*, the respective apertures 54, and the respective mirrors 55*a* and 55*b* of the first incident optical system 51 are disposed symmetrical to the respective collimator lens 57*a* and 57*b*, the respective apertures 58, and the respective mirrors 59*a* and 59*b* of the second incident optical system 52 placing the imaginary arrangement center line M as the center. The imaginary arrangement center line M passes through the center of the cylindrical lens 56. One half side of the cylindrical lens 56 divided by the imaginary arrangement center line M is disposed at the first incident optical system 51 while the other half side of the cylindrical lens 56 is disposed at the second incident optical system 52.

Further, the light scanning device 11 includes a first image-forming optical system 61 and a second image-forming optical system 62. The first image-forming optical system 61 guides the light fluxes L1 and L2 of the respective first semiconductor lasers 44*a* and 44*b* reflected by the polygonal mirror 42 to the two photosensitive drums 13 corresponding to black and cyan. The second image-forming optical system 62 guides the light fluxes L3 and L4 of the respective second semiconductor lasers 45*a* and 45*b* reflected by the polygonal mirror 42 to the two photosensitive drums 13 corresponding to magenta and yellow. The first image-forming optical system 61 is formed of an fθ lens 63, respective four reflective mirrors 64*a*, 64*b*, 64*c*, and 64*d*, and a similar lens. Similarly, the second image-forming optical system 62 is formed of an fθ lens 65, respective four reflective mirrors 66*a*, 66*b*, 66*c*, and 66*d*, and a similar lens. The fθ lens 63 and the respective reflective mirrors 64*a*, 64*b*, 64*c*, and 64*d* of the first image-forming optical system 61 are disposed symmetrical to the fθ lens 65 and the respective reflective mirrors 66*a*, 66*b*, 66*c*, and 66*d* of the second image-forming optical system 62 placing the imaginary arrangement center line M as the center.

A BD mirror 71 and a BD substrate 73 is disposed at the first image-forming optical system 61 side while a BD mirror 74 and a BD substrate 76 is also disposed at the second image-forming optical system 62 side. The BD substrate 73 includes a BD sensor 72. The BD substrate 76 includes a BD sensor 75. The BD mirror 71 and the BD sensor 72 at the first image-forming optical system 61 side are disposed symmetrical to the BD mirror 74 and the BD sensor 75 at the second image-forming optical system 62 side placing the imaginary arrangement center line M as the center.

Next, respective optical paths for the light fluxes L1 and L2 of the respective first semiconductor lasers 44*a* and 44*b* to enter the respective photosensitive drums 13, and respective optical paths for the light fluxes L3 and L4 of the respective second semiconductor lasers 45*a* and 45*b* to enter the respective photosensitive drums 13 will be described.

First, at the first incident optical system 51, the light flux L1 of the first semiconductor laser 44*a* transmits the collimator lens 53*a* and is made to parallel light. The light flux L1 is then reduced at the aperture 54, enters and is reflected by the respective mirrors 55*a* and 55*b*, transmits the cylindrical lens 56, and enters the reflecting surface 42*a* of the polygonal mirror 42. The light flux L2 of the first semiconductor laser 44*b* transmits the collimator lens 53*b* and is made to parallel light. The light flux L2 is then reduced at the aperture 54, passes through an empty space E under the mirror 55*b* (downward in the height direction Z), transmits the cylindrical lens 56, and enters the reflecting surface 42*a* of the polygonal mirror 42. The cylindrical lens 56 condenses the respective light fluxes L1 and L2 so as to almost converge the respective light fluxes L1 and L2 at the reflecting surface 42*a* of the polygonal mirror 42 only in the height direction Z.

Here, on the drive substrate 46 (the YZ plane), the respective first semiconductor lasers 44*a* and 44*b* are disposed at different positions from one another in the height direction Z. However, setting of the emission directions of the light fluxes L1 and L2 of the respective first semiconductor lasers 44*a* and 44*b* or the orientations of the respective mirrors 55*a* and 55*b* almost superimposes incident spots of the respective light fluxes L1 and L2 on the reflecting surface 42*a* of the polygonal mirror 42. In view of this, the light fluxes L1 and L2 of the respective first semiconductor lasers 44*a* and 44*b* enter from obliquely upward and obliquely downward to the reflecting surface 42*a* of the polygonal mirror 42. Viewed in the height direction Z, the respective light fluxes L1 and L2 enter the reflecting surface 42*a* with almost superimposed on the same straight line.

Then, at the first image-forming optical system 61, the respective light fluxes L1 and L2 reflected by the reflecting surface 42*a* of the polygonal mirror 42 are away from one another in obliquely downward and obliquely upward. The light flux L1 at one side is reflected by the reflecting surface 42*a* of the polygonal mirror 42 to obliquely downward, transmits the fθ lens 63, is reflected by the one reflective mirror 64*a*, and enters the photosensitive drum 13 where black toner image is to be formed. The light flux L2 at the other side is reflected by the reflecting surface 42*a* of the polygonal mirror 42 to obliquely upward, transmits the fθ lens 63, is sequentially reflected by the three reflective mirrors 64*b*, 64*c*, and 64*d*, and enters the photosensitive drum 13 where a cyan toner image is to be formed.

The polygonal motor 43 rotates the polygonal mirror 42 at equal angular velocity. Then, the polygonal mirror 42 sequentially reflects the respective light fluxes L1 and L2 at the respective reflecting surfaces 42*a*, and causes the respective light fluxes L1 and L2 to be repeatedly deflected at the equal angular velocity in the main-scanning direction X. The fθ lens 63 condenses and emits the respective light fluxes L1 and L2 in both the main-scanning direction X and the sub-scanning direction Y such that the respective light fluxes L1 and L2 may have a predetermined beam diameter at the surface of the respective photosensitive drums 13. Moreover, the fθ lens 63 transforms the respective light fluxes L1 and L2 deflected at the equal angular velocity in the main-scanning direction X by the polygonal mirror 42 such that the respective light fluxes L1 and L2 may move at the equal linear velocity along the main-scanning line on respective photosensitive drums 13. Thus, the respective light fluxes L1 and L2 are repeatedly scanned on the surface of respective photosensitive drums 13 in the main-scanning direction X.

Immediately before start of main scanning of the respective photosensitive drums 13 with the respective light fluxes L1 and L2, the light flux L1 at one side is reflected by the BD mirror 71 and enters the BD sensor 72. The BD sensor 72 receives the light flux L1 at timing immediately before the start of main scanning of the respective photosensitive drums 13, and outputs a BD signal indicating timing immediately before the start of the main scanning. Based on this BD signal, the timing of starting main scanning of the respective photosensitive drums 13 with the respective light fluxes L1 and L2 is set. Then, modulation of the respective light fluxes L1 and L2 according to the respective image data with black and cyan is started.

On the other hand, the respective photosensitive drums 13 where black and cyan toner images are to be formed are rotatably driven. The respective light fluxes L1 and L2 scan a two-dimensional surface (a circumference surface) of the respective photosensitive drums 13. Thus, respective electrostatic latent images are formed at the surfaces of the respective photosensitive drums 13.

Next, at the second incident optical system 52, the light flux L3 of the second semiconductor laser 45*a* transmits the collimator lens 57*a* and is made to parallel light. The light flux L3 is then reduced at the aperture 58, passes through the empty space E under the mirror 59*a* (downward in the height direction Z), transmits the cylindrical lens 56, and enters the reflecting surface 42*a* of the polygonal mirror 42. The light flux L4 of the second semiconductor laser 45*b* transmits the collimator lens 57*b* and is made to parallel light. The light flux L4 is then reduced at the aperture 58, enters and is reflected by the respective mirrors 59*a* and 59*b*, transmits the cylindrical lens 56, and enters the reflecting surface 42*a* of the polygonal mirror 42.

On the drive substrate 46 (the YZ plane), the respective second semiconductor lasers 45*a* and 45*b* are disposed at different positions from one another in the height direction Z. However, setting of the emission directions of the light fluxes L3 and L4 of the respective second semiconductor lasers 45*a* and 45*b* or the orientations of respective mirror 59*a* and 59*b* almost superimposes incident spots of the respective light fluxes L3 and L4 on the reflecting surface 42*a* of the polygonal mirror 42. In view of this, the light fluxes L3 and L4 of the respective second semiconductor lasers 45*a* and 45*b* enter from obliquely downward and obliquely upward to the reflecting surface 42*a* of the polygonal mirror 42. Viewed in the height direction Z, the respective light fluxes L3 and L4 enter the reflecting surface 42*a* with almost superimposed on the same straight line.

Then, at the second image-forming optical system 62, the respective light fluxes L3 and L4 reflected by the reflecting surface 42*a* of the polygonal mirror 42 are away from one another in obliquely upward and obliquely downward. The light flux L3 at one side is reflected by the reflecting surface 42*a* of the polygonal mirror 42 to obliquely upward, transmits the fθ lens 65, is sequentially reflected by the three reflective mirrors 66*b*, 66*c*, and 66*d*, and enters the photosensitive drum 13 where magenta toner image is to be formed. The light flux L4 at the other side is reflected by the reflecting surface 42*a* of the polygonal mirror 42 to obliquely downward, transmits the fθ lens 65, is reflected by the one reflective mirror 66*a*, and enters the photosensitive drum 13 where yellow toner image is to be formed.

Immediately before start of main scanning of the respective photosensitive drums 13 with the respective light fluxes L3 and L4, the other light flux L4 is reflected by the BD mirror 74 and enters the BD sensor 75. The BD sensor 75 outputs a BD signal indicating timing immediately before the start of the main scanning of the respective photosensitive drums 13 with the respective light fluxes L3 and L4. According to this BD signal, the timing of starting main scanning of the respective photosensitive drums 13 where cyan and black toner images are to be formed is determined. Then, modulation of the respective light fluxes L3 and L4 according to respective cyan and black image data is started.

On the other hand, the respective photosensitive drums 13 where magenta and yellow toner images are to be formed are rotatably driven. The respective light fluxes L3 and L4 scan a two-dimensional surface (a circumference surface) of the respective photosensitive drums 13. Thus, respective electrostatic latent images are formed at the surfaces of the respective photosensitive drums 13.

The light scanning device 11 with this constitution includes the polygonal mirror 42 at the approximately center of the bottom plate 41*a* of the housing 41. The light scanning device 11 includes the respective first semiconductor lasers 44*a* and 44*b* and the respective second semiconductor lasers 45*a* and 45*b* disposed symmetrically to one another placing the imaginary arrangement center line M passing through the rotational center of the polygonal mirror 42 as the center. Here, the first incident optical system 51 is disposed symmetrically to the second incident optical system 52, and the first image-forming optical system 61 is disposed symmetrically to the second image-forming optical system 62. This allows downsizing the light scanning device 11 viewed from the side by aggregating the polygonal mirror 42, the respective first semiconductor lasers 44*a* and 44*b*, the respective second semiconductor lasers 45*a* and 45*b*, the first incident optical system 51, the second incident optical system 52, or a similar component in a small space.

Figure 6:
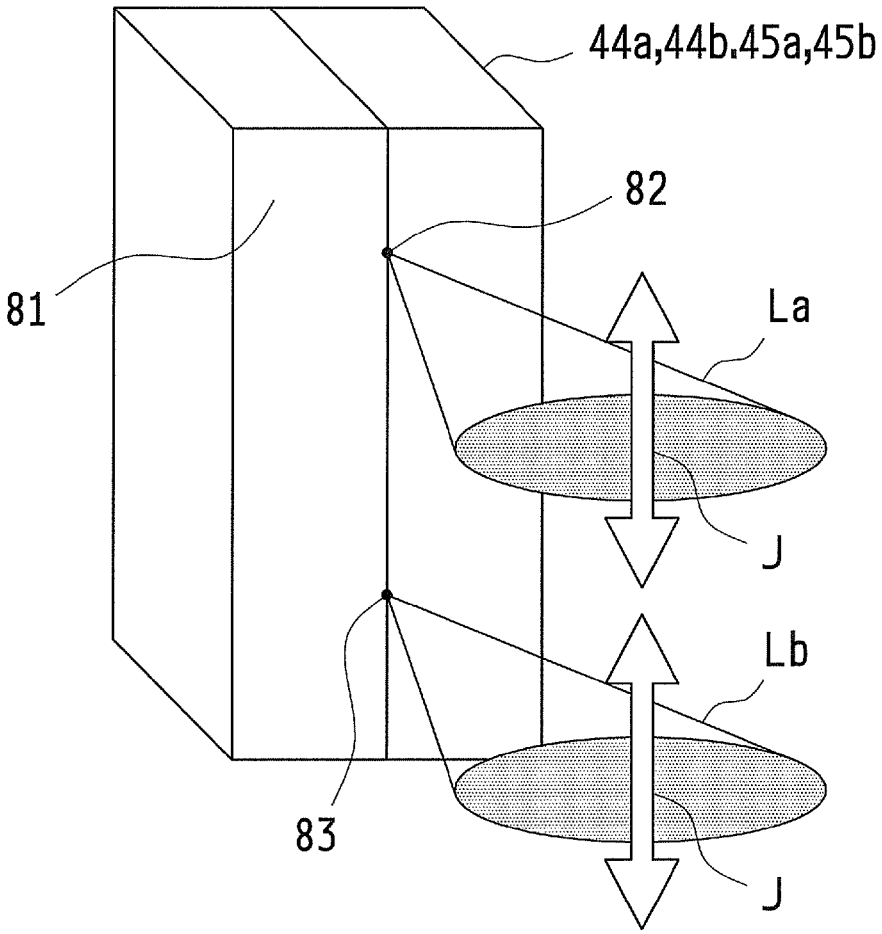
FIG. 6 is a perspective view conceptually illustrating semiconductor lasers.

Each of the first semiconductor lasers 44*a* and 44*b* and each of the second semiconductor lasers 45*a* and 45*b* emit two light fluxes (multibeam) in linear polarization. FIG. 6 is a perspective view conceptually illustrating the respective first semiconductor lasers 44*a* and 44*b* and the respective second semiconductor lasers 45*a* and 45*b*. As illustrated in FIG. 6, one end surfaces of the respective first semiconductor lasers 44*a* and 44*b* and the respective second semiconductor lasers 45*a* and 45*b* form a light-emitting surface 81. The light-emitting surfaces 81 forms two light-emitting points 82 and 83. Each of the light-emitting points 82 and 83 emits two light fluxes La and Lb. The respective light fluxes La and Lb are linearly polarized, and have the same polarization direction J.

In FIG. 2 to FIG. 5, each of the light fluxes L1 to L4 corresponds to the respective two light fluxes La and Lb. Also, for any of the respective first semiconductor lasers 44*a* and 44*b* and the respective second semiconductor lasers 45*a* and 45*b*, the respective light-emitting points 82 and 83 of the light-emitting surfaces 81 are arranged in the height direction Z (or in the YZ direction). The respective light fluxes La and Lb are emitted from the light-emitting surface 81 spacing in the height direction Z (or in the YZ direction) and enter the reflecting surface 42*a* of the polygonal mirror 42. Then, the respective light fluxes La and Lb are reflected by the reflecting surface 42*a* of the polygonal mirror 42. Further, the respective light fluxes La and Lb are reflected by the respective reflective mirrors 64*a* to 64*d* and 66*a* to 66*d* in the height direction Z, enter the surfaces of the respective photosensitive drums 13 spacing in the sub-scanning direction Y (or in the XY direction). Thus, the respective light fluxes La and Lb simultaneously scan the two main-scanning lines on the surfaces of the respective photosensitive drums 13.

In view of this, a space is generated at the incident position of the respective light fluxes La and Lb in the sub-scanning direction Y on the surfaces of the photosensitive drums 13. This may displace the incident positions of the respective light fluxes La and Lb in the main-scanning direction X. The space (the space for two main-scanning lines) at the incident positions of the respective light fluxes La and Lb in the sub-scanning direction Y is set at uniform intervals by rotating the light-emitting surface 81 for each of the first semiconductor lasers 44*a* and 44*b* and the second semiconductor lasers 45*a* and 45*b* separately so as to adjust a distance between the respective light-emitting points 82 and 83 of the light-emitting surfaces 81 in the height direction Z. Displacement of the incident positions of the respective light fluxes La and Lb in the main-scanning direction X is corrected by adjusting modulation start timing of the respective light fluxes La and Lb and matching start positions of writing respective main-scanning lines to the surfaces of the photosensitive drums 13 with the respective light fluxes La and Lb.

Figure 7:
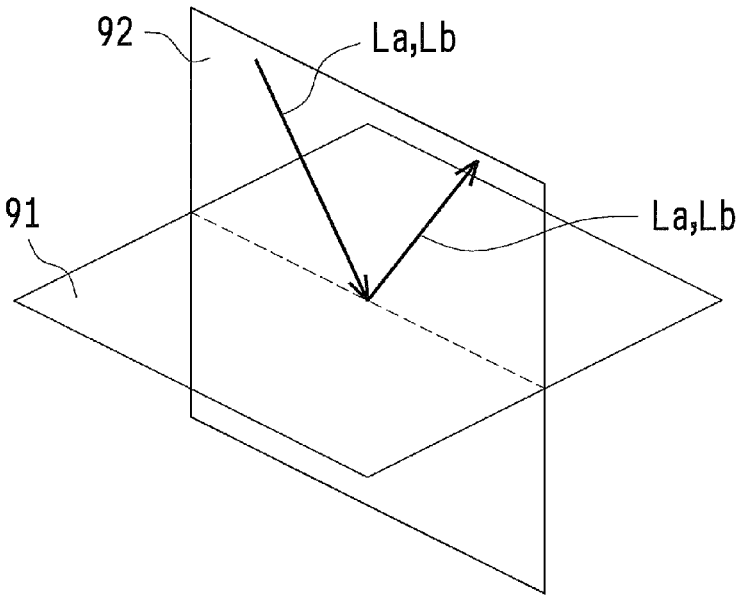
FIG. 7 is a perspective view schematically illustrating a reflecting surface and an incident surface including a light flux that enters and is reflected by the reflecting surface.

Here, as illustrated in FIG. 7, the reflecting surface 42*a* of the polygonal mirror 42 and the reflecting surfaces of the respective reflective mirror 64*a* to 64*d* and 66*a* to 66*d* are assumed as a reflecting surface 91. A plane including the light flux La or Lb entering and is reflected by the reflecting surface 91 is assumed as an incident surface 92. The reflecting surface 91 is perpendicular to the incident surface 92. In the case where the polarization direction J (vibrating direction of electric field) of the respective light fluxes La and Lb in linear polarization is vertical to the incident surface 92, the respective light fluxes La and Lb become S polarization with respect to the reflecting surface 91. Regardless of the angles of incidence and the reflection angles of the respective light fluxes La and Lb with respect to the reflecting surface 91, the reflectivity of the reflecting surface 91 becomes approximately uniform. In the case where the polarization directions J of the respective light fluxes La and Lb are parallel to the incident surface 92, the respective light fluxes La and Lb become P polarization with respect to the reflecting surface 91. The reflectivity of the reflecting surface 91 is largely changed according to the angles of incidence and the reflection angles of the respective light fluxes La and Lb with respect to the reflecting surface 91.

Figure 8:
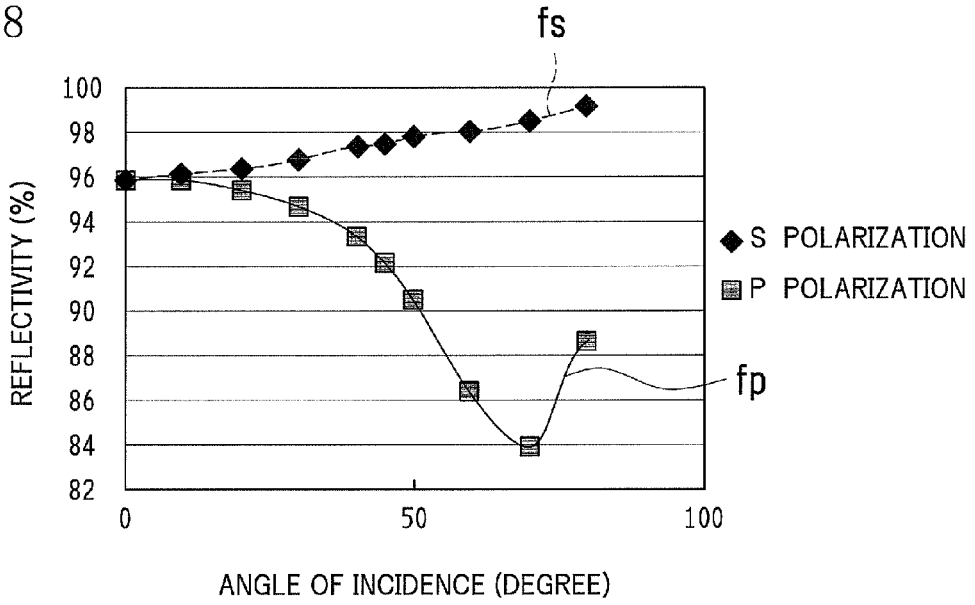
FIG. 8 is a graph illustrating reflectance characteristics of S polarization and P polarization that vary according to an angle of incidence or a reflection angle of the light flux with respect to the reflecting surface.

FIG. 8 is a graph illustrating reflectance characteristics fs and fp of S polarization and P polarization that change according to an angle of incidence or a reflection angle of the light flux with respect to the reflecting surface. As apparent from the reflectance characteristics fs of S polarization, although the reflectivity for S polarization slightly changes according to the angle of incidence or the reflection angle of the light flux, the reflectivity is maintained almost uniform. As apparent from reflectance characteristics fp for P polarization, the reflectivity of P polarization largely changes according to the angle of incidence or the reflection angle of the light flux.

Further, in the case where the polarization directions J of the respective light fluxes La and Lb (the linear polarization) are inclined with respect to the incident surface 92, a ratio of the S polarized component to the P polarized components of the respective light fluxes La and Lb with respect to the reflecting surface 91 changes according to the inclination angle of the polarization directions J of the respective light fluxes La and Lb with respect to the incident surface 92. Then, since the reflectivity for P polarization is largely changed according to the angles of incidence or the reflection angles of the respective light fluxes La and Lb with respect to the reflecting surface 91, the larger the ratio of P polarized component, the larger a change in reflectivity of the respective light fluxes La and Lb. For example, assume the case where the respective light fluxes La and Lb enter the reflecting surface 42*a* of the polygonal mirror 42 and the reflecting surfaces of the respective reflective mirrors 64*a* to 64*d* and 66*a* to 66*d*. When the polarization directions J of the respective light fluxes La and Lb are inclined to respective incident surfaces perpendicular to the reflecting surfaces, ratios of the P polarized components of the respective light fluxes La and Lb with respect to the reflecting surfaces are increased depending on the inclination angles of the polarization directions J of the respective light fluxes La and Lb with respect to the incident surfaces. Further, the reflectivities of the respective light fluxes La and Lb largely change according to the angle of incidence and the reflection angle with respect to the reflecting surfaces.

Since the angles of incidence and the reflection angles of the respective light fluxes La and Lb with respect to these reflecting surfaces change in association with the deflections of the respective light fluxes La and Lb by the polygonal mirror 42, the angles of incidence and the reflection angles change according to the scan positions of the photosensitive drums 13 by the respective light fluxes La and Lb. Since the reflectivities of P polarization change according to the angles of incidence and the reflection angles of the respective light fluxes La and Lb with respect to these reflecting surfaces, the reflectivities change according to the scan positions of the photosensitive drums 13 with the respective light fluxes La and Lb. In view of this, if ratios of the P polarized components of the respective light fluxes La and Lb with respect to these reflecting surfaces are increased, the incident light quantity distributions of the respective light fluxes La and Lb in the scanning direction at the surface of the photosensitive drum 13 are unbalanced.

Further, as described above, the light-emitting surfaces 81 of the respective first semiconductor lasers 44*a* and 44*b* and the light-emitting surfaces 81 of the respective second semiconductor lasers 45*a* and 45*b* are rotated separately, and a distance between respective light-emitting points 82 and 83 of the light-emitting surfaces 81 are adjusted in the height direction Z. Thus, rotation of the light-emitting surfaces 81 changes the polarization directions J of the respective light fluxes La and Lb (the linear polarization). This may further increases ratios of the P polarized components of the respective light fluxes La and Lb with respect to the reflecting surfaces. This further increase unbalance of incident light quantity distributions of the respective light fluxes La and Lb at the surfaces of the photosensitive drums 13.

Therefore, when the light scanning device 11 rotates the light-emitting surfaces 81 of the respective first semiconductor lasers 44*a* and 44*b* and the respective second semiconductor lasers 45*a* and 45*b* separately so as to adjust a distance between the respective light-emitting points 82 and 83 in the height direction Z at the light-emitting surfaces 81, rotation directions of the light-emitting surfaces 81 are set such that unbalance of the reflectance distributions of the respective light fluxes La and Lb at the reflecting surface 42*a* of the polygonal mirror 42 and unbalance of the reflectance distributions of the respective light fluxes La and Lb at the reflecting surfaces of the respective reflective mirrors 64*a* to 64*d* and 66*a* to 66*d* are cancelled one another. This uniforms the incident light quantity distributions of the respective light fluxes La and Lb at the surfaces of the photosensitive drums 13.

Figure 9:
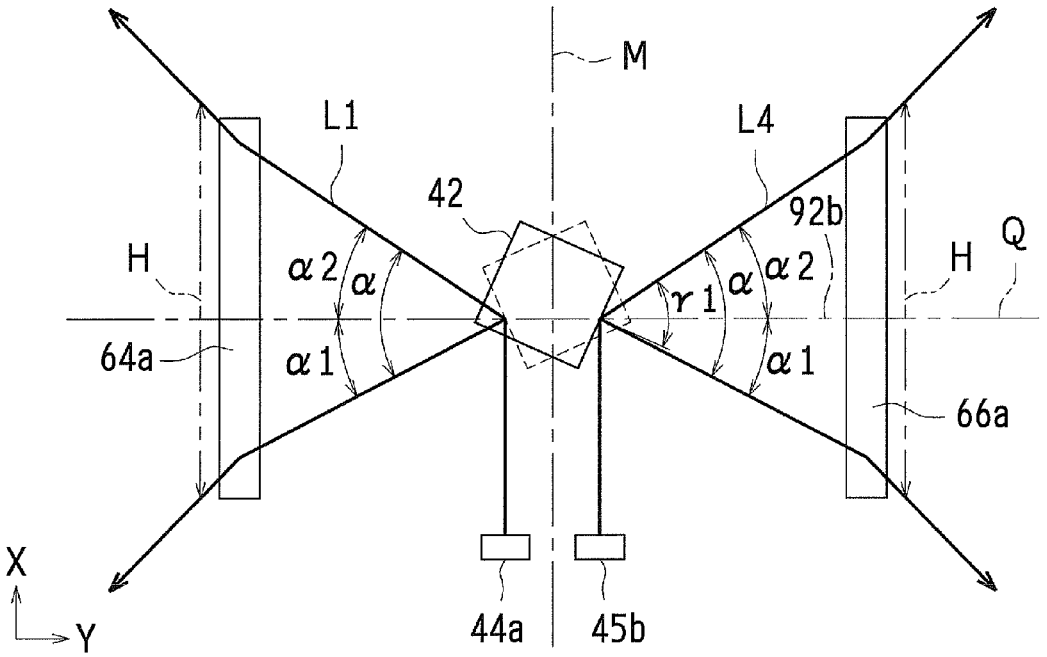
FIG. 9 is a plan view schematically illustrating a light flux emitted from the semiconductor laser, the polygonal mirror, and the reflective mirror.

Next, the following describes a rotation direction of such light-emitting surface 81 in detail. First, the following describes the reflecting surface 42*a* of the polygonal mirror 42, the reflecting surfaces of the respective reflective mirrors 64*a* and 66*a*, respective incident surfaces perpendicular to these reflecting surfaces, or a similar surface. FIG. 9 is a plan view schematically illustrating the first and second semiconductor lasers 44*a* and 45*b*, the respective light fluxes L1 and L4, the polygonal mirror 42, the respective reflective mirrors 64*a* and 66*a*, or a similar component. FIG. 9 omits illustration of other optical members. In FIG. 9, reflecting the light flux L4 (or L1) at the reflecting surface 42*a* of the polygonal mirror 42 repeatedly deflects the light flux L4 (or L1) in an approximately fan-shaped range. The approximately fan-shaped range includes a scan deflection range α of the light flux L4 (or L1). The scan deflection range α is a range within which the polygonal mirror 42 deflects the light flux L4 (or L1) in a scan period from a start of scanning an effective scan area H of the photosensitive drum 13 to an end of the scanning. The effective scan area H is an area on the photosensitive drum 13 scanned by the light flux L4 (or L1) and is a region including a formation region of electrostatic latent image. In practice, the effective scan area H of the photosensitive drum 13 is positioned upward of the reflective mirror 66*a* (or 64*a*); however, FIG. 9 illustrates the effective scan area H by expanding the effective scan area H in a two-dimensional plane.

The polygonal mirror 42 rotates placing the rotation axis in the height direction Z as the center. The reflecting surface 42*a* of the polygonal mirror 42 is maintained always parallel to the height direction Z. The light flux L4 (or L1) enters the reflecting surface 42*a* in the main-scanning direction X and is reflected by the reflecting surface 42*a* in the Y direction or the XY direction. Accordingly, an incident surface 92*a* (illustrated in FIG. 10) including the light flux L4 (or L1), which enters and is reflected by the reflecting surface 42*a*, becomes XY plane.

A line along the light flux L4 (or L1) reflected by the reflecting surface 42*a* of the polygonal mirror 42 is deflected and enters the center of the reflecting surface of the reflective mirror 66*a* (or 64*a*) in the deflection direction of the light flux L4 (or L1) is defined as an imaginary deflection center line Q. The scan deflection range α is divided into two by the imaginary deflection center line Q. One side of the divided scan deflection range α is defined as a first deflection range α1, and the other divided scan deflection range α is defined as a second deflection range α2. The first deflection range α1 is closer to the second semiconductor laser 45*b* (or the first semiconductor laser 44*a*) than the imaginary deflection center line Q, and therefore is at the incident side of the light flux L4 (or L1). The second deflection range α2 is distant from the second semiconductor laser 45*b* (or the first semiconductor laser 44*a*) more than the imaginary deflection center line Q, and therefore is at the opposite side from the incident side of the light flux L4 (or L1). In view of this, a reflection angle γ1 of the light flux L4 (or L1) with respect to the reflecting surface 42*a* of the polygonal mirror 42 becomes smaller at the first deflection range α1 than the second deflection range α2. For example, the reflection angle γ1 of the light flux L4 (or L1) with respect to the reflecting surface 42*a* of the polygonal mirror 42 is approximately 10° to 60°.

Figure 10:
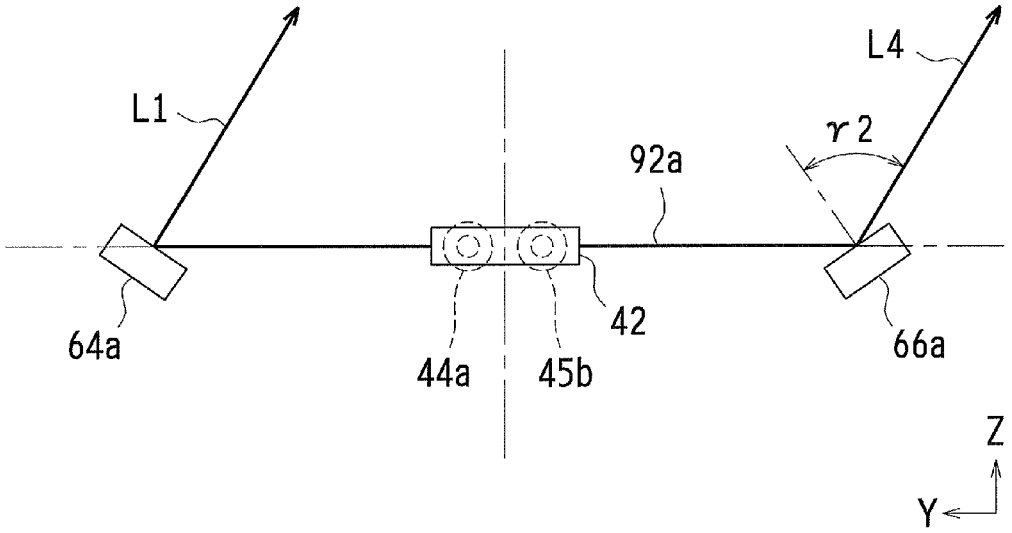
FIG. 10 is a side view schematically illustrating a light flux emitted from the semiconductor laser, the polygonal mirror, and the reflective mirror.

FIG. 10 is a side view schematically illustrating the respective light fluxes L1 and L4, the polygonal mirror 42, and the respective reflective mirrors 64*a* and 66*a*. FIG. 10 omits illustration of other optical members. In FIG. 10, the light flux L4 (or L1) is reflected by the reflecting surface 42*a* of the polygonal mirror 42 and enters the reflecting surface of the reflective mirror 66*a* (or 64*a*). Further, the light flux L4 (or L1) is reflected by the reflecting surface of the reflective mirror 66*a* (or 64*a*) in the height direction Z, and enters the surface of the photosensitive drum 13. When the polygonal mirror 42 deflects the light flux L4 (or L1) in the main-scanning direction X, the light flux L4 (or L1) reflected by the reflecting surface of the reflective mirror 66*a* (or 64*a*) scans the effective scan area H of the photosensitive drum 13 in the main-scanning direction X. A reflection angle γ2 of the light flux L4 with respect to the reflecting surface of the reflective mirror 66*a* at one side is, for example, more than 45°. The light flux L4 that enters the reflecting surface of the reflective mirror 66*a* and the light flux L4 reflected by the reflecting surface form an obtuse angle (an angle twice of γ2))(>90°.

The light flux L4 (or L1) enters the reflecting surface of the reflective mirror 66*a* (or 64*a*) in the sub-scanning direction Y or the XY direction and is reflected in the height direction Z. An incident surface 92*b* (illustrated in FIG. 9) including the light flux L4 (or L1), which enters and is reflected by the reflecting surface of the reflective mirror 66*a* (or 64*a*), becomes the YZ plane or a plane inclined with respect to the YZ plane. On the imaginary deflection center line Q, the incident surface 92*b* becomes the YZ plane and perpendicular to the XY plane. The incident surface 92*b* in the first deflection range α1 and the incident surface 92*b* in the second deflection range α2 are symmetrically inclined to one another with respect to the YZ plane on the imaginary deflection center line Q and intersect with the XY plane.

The following describes relationship between a rotation direction of the light-emitting surface 81 of the second semiconductor laser 45*b* and incident light quantity distribution of light flux at the surface of the photosensitive drum 13 of the first embodiment with reference to the diagram in FIG. 11. FIG. 11 is a diagram illustrating rotation positions of the light-emitting surface 81 of the second semiconductor laser 45*b*, the reflecting surface 42*a* of the polygonal mirror 42, reflectance distributions at the reflecting surface 42*a* in the main-scanning direction X, the reflecting surface of the reflective mirror 66*a*, the reflectance distributions at the reflecting surface of the reflective mirror 66*a* in the main-scanning direction X, incident light quantity distributions at the surface of the photosensitive drum 13 in the main-scanning direction X, and similar items.

In (I) of the column A in FIG. 11, the light-emitting surface 81 of the second semiconductor laser 45*b* is rotated such that the respective light-emitting points 82 and 83 of the light-emitting surface 81 of the second semiconductor laser 45*b* are arranged along the height direction Z. The polarization directions J of the respective light fluxes La and Lb (the linear polarization) emitted from respective light-emitting points 82 and 83 are set parallel to the height direction Z.

In this case, as illustrated in (II) of the column A in FIG. 11, the polarization direction J (the height direction Z) of the respective light fluxes La and Lb are vertical to the incident surface 92*a* (the XY plane) including the respective light fluxes La and Lb that enters and is reflected by the reflecting surface 42*a* of the polygonal mirror 42. The polarization directions J of the respective light fluxes La and Lb with respect to the reflecting surface 42*a* of the polygonal mirror 42 are directions of when the reflecting surface 42*a* of the polygonal mirror 42 is viewed from the second semiconductor laser 45*b* side.

Accordingly, as illustrated in (III) and (IV) of the column A in FIG. 11, the respective light fluxes La and Lb become only the S polarized component with respect to the reflecting surface 42*a*. Regardless of the angles of incidence and the reflection angles of the respective light fluxes La and Lb with respect to the reflecting surface 42*a*, that is, regardless of whether the light flux L4 is deflected at any of the first and the second deflection ranges α1 and α2, the reflectance distribution at the reflecting surface 42*a* becomes approximately uniform. Therefore, the reflectivity of the reflecting surface 42*a* of the polygonal mirror 42 becomes approximately uniform at any position in the main-scanning direction X.

As illustrated in (V) of the column A in FIG. 11, the polarization direction J (the height direction Z) of the respective light fluxes La and Lb are not vertical to the incident surface 92*b* including the light flux La or Lb that enter and are reflected by the reflecting surface of the reflective mirror 66*a*. The polarization directions J of the respective light fluxes La and Lb with respect to the reflecting surface of the reflective mirror 66*a* are directions of when the reflecting surface of the reflective mirror 66*a* is viewed from the polygonal mirror 42 side.

On the imaginary deflection center line Q, the polarization directions J of the respective light fluxes La and Lb are parallel to the incident surface 92*b*; therefore, the respective light fluxes La and Lb become to have only P polarized component with respect to the reflecting surface of the reflective mirror 66*a*. The respective incident surfaces 92*b* in the first deflection range α1 and the second deflection range α2 are symmetrically inclined to one another with respect to the YZ plane on the imaginary deflection center line Q. Accordingly, the polarization directions J of the respective light fluxes La and Lb are inclined at respective inclination angles in reverse direction to one another with respect to the respective incident surfaces 92*b*. Accordingly, the respective light fluxes La and Lb include both the S polarized component and the P polarized component with respect to the reflecting surface of the reflective mirror 66*a*. As the respective light fluxes La and Lb become distant from the imaginary deflection center line Q, the respective inclination angles become larger. This reduces a ratio of the P polarized components of the respective light fluxes La and Lb while increasing a ratio of the S polarized components of the respective light fluxes La and Lb.

As apparent from FIG. 10, the respective light fluxes La and Lb that enter the reflecting surface of the reflective mirror 66*a* and the respective light fluxes La and Lb reflected by the reflecting surface form an obtuse angle (the angle of incidence and the reflection angle γ2 exceed 45°). This angle is uniformly maintained almost in both the first and the second deflection ranges α1 and α2. Regarding the P polarized components of the respective light fluxes La and Lb, the reflectivity of reflecting surface of the reflective mirror 66*a* largely decreases. As illustrated in (VI) and (VII) of the column A in FIG. 11, since the respective light fluxes La and Lb become to have only the P polarized component on the imaginary deflection center line Q, the reflectivity of the reflecting surface of the reflective mirror 66*a* becomes the smallest. In the first and the second deflection ranges α1 and α2, as the respective light fluxes La and Lb become distant from the imaginary deflection center line Q, the P polarized components of the respective light fluxes La and Lb decrease and the S polarized components of the respective light fluxes La and Lb increase. Accordingly, the reflectivity of the reflecting surface of the reflective mirror 66*a* gradually increases. Therefore, the reflectivity of the reflecting surface of the reflective mirror 66*a* becomes the smallest at the center in the main-scanning direction X and gradually increases as distant from the center.

Here, the respective light fluxes La and Lb are reflected by the reflecting surface 42*a* of the polygonal mirror 42 and the reflecting surface of the reflective mirror 66*a* and then enter the surfaces of the photosensitive drums 13. The reflecting surface 42*a* of the polygonal mirror 42 has a reflectance distribution illustrated in (IV) of the column A in FIG. 11. The reflecting surface of the reflective mirror 66*a* has a reflectance distribution illustrated in (VII) of the column A in FIG. 11. Accordingly, these respective light fluxes La and Lb are equivalent to the respective light fluxes La and Lb that are reflected by an imaginary reflecting surface with the reflectance distribution illustrated in (VIII) of the column A in FIG. 11, which is a combination of these reflectance distributions (IV) and (VII), and enters the surface of the photosensitive drum 13. The reflectance distribution at the reflecting surface 42*a* of the polygonal mirror 42 is approximately uniform. Accordingly, similarly to the reflectance distribution at the reflecting surface of the reflective mirror 66*a*, the reflectance distribution illustrated in (VIII) of the column A in FIG. 11 becomes the smallest on the imaginary deflection center line Q. In the first and the second deflection ranges α1 and α2, the reflectance distribution gradually increases as distant from the imaginary deflection center line Q. Accordingly, the incident light quantity distributions of the respective light fluxes La and Lb at the surface of the photosensitive drums 13 become the smallest at the center in the main-scanning direction X and gradually increases as distant from the center.

Next, in (I) of the column B in FIG. 11, the light-emitting surface 81 of the second semiconductor laser 45*b* is rotated in the F1 direction such that the light-emitting point 82 at the upper side of the light-emitting surface 81 approaches the imaginary arrangement center line M and the light-emitting point 83 at the lower side goes away from the imaginary arrangement center line M. Thus, the polarization directions of the respective light fluxes La and Lb emitted from respective light-emitting points 82 and 83 are inclined to the YZ direction.

In this case, as illustrated in (II) of the column B in FIG. 11, the polarization directions J (the YZ direction) of the respective light fluxes La and Lb (the linear polarization) are inclined with respect to the incident surface 92*a* (the XY plane) including the respective light fluxes La and Lb that enter and are reflected by the reflecting surface 42*a* of the polygonal mirror 42. In view of this, the respective light fluxes La and Lb include both the S polarized component and the P polarized component with respect to the reflecting surface 42*a*. As illustrated in (III) and (IV) of the column B in FIG. 11, when the respective light fluxes La and Lb are deflected in the first deflection range α1, as the respective light fluxes La and Lb approach the imaginary deflection center line Q, the angles of incidence and the reflection angles of the respective light fluxes La and Lb with respect to the reflecting surface 42*a* gradually increase, and the reflectivities of the P polarized components of the respective light fluxes La and Lb gradually decrease. Subsequently, in the case where the respective light fluxes La and Lb are on the imaginary deflection center line Q, the angles of incidence and the reflection angles of the respective light fluxes La and Lb with respect to the reflecting surface 42*a* smoothly change, and the reflectivities of the P polarized components of the respective light fluxes La and Lb also smoothly change. Further, when the respective light fluxes La and Lb are deflected in the second deflection range α2, as the respective light fluxes La and Lb become distant from the imaginary deflection center line Q, the angles of incidence and the reflection angles of the respective light fluxes La and Lb with respect to the reflecting surface 42*a* gradually further increase, and the reflectivities of the P polarized components of the respective light fluxes La and Lb gradually further decrease. Therefore, the reflectivity of the reflecting surface 42*a* gradually decreases from the first deflection range α1 to the second deflection range α2.

As illustrated in (V) of the column B in FIG. 11, any of in the first deflection range α1, on the imaginary deflection center line Q, and in the second deflection range α2, the polarization directions J (the YZ direction) of the respective light fluxes La and Lb are inclined to the same direction with respect to the incident surface 92*b* including the light flux La or Lb that enter and are reflected by the reflecting surface of the reflective mirror 66*a*. Accordingly, the respective light fluxes La and Lb include both the S polarized component and the P polarized component with respect to the reflecting surface of the reflective mirror 66*a*.

The light-emitting surface 81 is rotated in the F1 direction. Accordingly, the inclination angle of the polarization direction J with respect to the incident surface 92*b* when the respective light fluxes La and Lb are deflected in the first deflection range α1 becomes smaller than the inclination angle of the polarization direction J with respect to the incident surface 92*b* when the respective light fluxes La and Lb are deflected in the second deflection range α2. When the respective light fluxes La and Lb are deflected in the first deflection range α1, as the respective light fluxes La and Lb approach the imaginary deflection center line Q, the inclination angle of the polarization direction J gradually increases. Subsequently, in the case where the respective light fluxes La and Lb are on the imaginary deflection center line Q, the inclination angle of the polarization direction J smoothly changes. Further, when the respective light fluxes La and Lb are deflected in the second deflection range α2, as the respective light fluxes La and Lb become distant from the imaginary deflection center line Q, the inclination angle of the polarization direction J gradually further increases. Accordingly, as illustrated in (VI) and (VII) of the column B in FIG. 11, the ratio of the P polarized components of the respective light fluxes La and Lb gradually decreases from the first deflection range α1 to the second deflection range α2 and the ratio of the S polarized components of the respective light fluxes La and Lb gradually increases.

The respective light fluxes La and Lb that enter the reflecting surface of the reflective mirror 66*a* and the respective light fluxes La and Lb reflected by the reflecting surface form an obtuse angle of almost uniform (the angle of incidence and the reflection angle γ2 exceed 45°). Accordingly, regarding the P polarized components of the respective light fluxes La and Lb, the reflectivity of reflecting surface of the reflective mirror 66*a* largely decreases. Accordingly, the reflectivity of reflecting surface of the reflective mirror 66*a* gradually increases from the first deflection range α1 to the second deflection range α2.

Further, the reflecting surface 42*a* of the polygonal mirror 42 has a reflectance distribution illustrated in (IV) of the column B in FIG. 11. The reflecting surface of the reflective mirror 66*a* has a reflectance distribution illustrated in (VII) of the column B in FIG. 11. Accordingly, unbalance of these reflectance distributions are cancelled one another. In view of this, these respective light fluxes La and Lb are equivalent to the respective light fluxes La and Lb that are reflected by the imaginary reflecting surface with the reflectance distribution of approximately uniform illustrated in (VIII) of the column B in FIG. 11, which is a combination of these reflectance distributions (IV) and (VII), and enter the surfaces of the photosensitive drums 13. Therefore, the incident light quantity distributions of the respective light fluxes La and Lb at the surfaces of the photosensitive drums 13 are also approximately uniform.

Thus, the rotation of the light-emitting surface 81 of the second semiconductor laser 45*b* in the F1 direction allows unbalance of the reflectance distribution at the reflecting surface 42*a* of the polygonal mirror 42 and unbalance of the reflectance distribution at the reflecting surface of the reflective mirror 66*a* to be cancelled one another, thus the incident light quantity distributions of the respective light fluxes La and Lb at the surface of the photosensitive drum 13 become approximately uniform. In view of this, when a distance between the respective light-emitting points 82 and 83 at the light-emitting surface 81 of the second semiconductor laser 45*b* in the height direction Z is adjusted, rotation of the light-emitting surface 81 in the F1 direction allows reducing unbalance of the incident light quantity distributions of the respective light fluxes La and Lb at the surface of the photosensitive drum 13.

In particular, as illustrated in FIG. 10, in the case where the respective light fluxes La and Lb that enter the reflecting surface of the reflective mirror 66*a* and the respective light fluxes La and Lb reflected by the reflecting surface form obtuse angles of almost uniform (the angle of incidence and the reflection angle γ2 exceed 45°), the reflectivities of the P polarized components of the respective light fluxes La and Lb are largely reduced. This causes unbalance of the incident light quantity distribution at the surface of the photosensitive drum 13. However, only rotation of the light-emitting surface 81 in the F1 direction allows reducing such unbalance of the incident light quantity distribution.

Next, as a comparative example, the following describes unbalance of incident light quantity distribution when the light-emitting surface 81 is rotated in the reverse direction to the F1 direction with reference to the diagram in FIG. 12. FIG. 12 is a diagram listing respective items similar to FIG. 11.

In (I) of FIG. 12, the light-emitting surface 81 of the second semiconductor laser 45*b* is rotated in the F2 direction, which is the reverse direction to the F1 direction, such that the light-emitting point 82 at the upper side of the light-emitting surface 81 is away from the imaginary arrangement center line M and the light-emitting point 83 at the lower side approaches the imaginary arrangement center line M. Thus, the polarization directions of the respective light fluxes La and Lb emitted from the respective light-emitting points 82 and 83 are inclined to the YZ direction.

In this case, as illustrated in (II) of FIG. 12, the polarization directions J (the YZ direction) of the respective light fluxes La and Lb (the linear polarizations) are inclined with respect to the incident surface 92*a* (the XY plane) including the respective light fluxes La and Lb that enter and are reflected by the reflecting surface 42*a* of the polygonal mirror 42. In view of this, the respective light fluxes La and Lb contain both the S polarized component and the P polarized component with respect to the reflecting surface 42*a*. As illustrated in (III) and (IV) of FIG. 12, in the case where the light-emitting surface 81 is rotated in the F2 direction, similarly to rotation in the F1 direction, when the respective light fluxes La and Lb are deflected in the first deflection range α1, as the respective light fluxes La and Lb approach the imaginary deflection center line Q, the reflectivities of the P polarized components of the respective light fluxes La and Lb gradually decrease. Subsequently, in the case where the respective light fluxes La and Lb are on the imaginary deflection center line Q, the reflectivities of the P polarized components of the respective light fluxes La and Lb smoothly change. Further, when the respective light fluxes La and Lb are deflected in the second deflection range α2, as the respective light fluxes La and Lb become distant from the imaginary deflection center line Q, the reflectivities of the P polarized components of the respective light fluxes La and Lb are gradually further reduced. Therefore, reflectivity of the reflecting surface 42*a* gradually decreases from the first deflection range α1 to the second deflection range α2.

As illustrated in (V) of FIG. 12, any of in the first deflection range α1, on the imaginary deflection center line Q, and in the second deflection range α2, the polarization directions J (the YZ directions) of the respective light fluxes La and Lb are inclined to the same direction with respect to the incident surface 92*b* including the light flux La or Lb that enter and are reflected by the reflecting surface of the reflective mirror 66*a*. Accordingly, the respective light fluxes La and Lb include both the S polarized component and the P polarized component with respect to the reflecting surface of the reflective mirror 66*a*.

The light-emitting surface 81 is rotated in the F2 direction, which is the reverse direction to the F1 direction. Accordingly, the inclination angle of the polarization direction J with respect to the incident surface 92*b* when the respective light fluxes La and Lb are deflected in the first deflection range α1 becomes larger than the inclination angle of the polarization direction J with respect to the incident surface 92*b* when the respective light fluxes La and Lb are deflected in the second deflection range α2. When the respective light fluxes La and Lb are deflected in the first deflection range α1, as the respective light fluxes La and Lb approach the imaginary deflection center line Q, the inclination angle of the polarization direction J gradually decreases. Subsequently, in the case where the respective light fluxes La and Lb are on the imaginary deflection center line Q, the inclination angle of the polarization direction J smoothly changes. Further, when the respective light fluxes La and Lb are deflected in the second deflection range α2, as the respective light fluxes La and Lb become distant from the imaginary deflection center line Q, the inclination angle of the polarization direction J gradually further decreases. Accordingly, as illustrated in (VI) and (VII) of FIG. 12, the ratios of the P polarized components of the respective light fluxes La and Lb are increased from the first deflection range α1 to the second deflection range α2 and the ratios of the S polarized components of the respective light fluxes La and Lb decrease. Thus, reflectivity of the reflecting surface of the reflective mirror 66*a* gradually decreases. Therefore, reflectivity of the reflecting surface of the reflective mirror 66*a* gradually decreases from the first deflection range α1 to the second deflection range α2.

Further, the reflecting surface 42*a* of the polygonal mirror 42 has a reflectance distribution illustrated in (IV) of FIG. 12. The reflecting surface of the reflective mirror 66*a* has a reflectance distribution illustrated in (VII) of FIG. 12. Accordingly, changes in these reflectance distributions synergize with one another. In view of this, these respective light fluxes La and Lb are equivalent to the respective light fluxes La and Lb that are reflected by the imaginary reflecting surface with the reflectance distribution illustrated in (VIII) of FIG. 12, which is a combination of these reflectance distributions (IV) and (VII), that is, a reflectance distribution that largely decreases from the first deflection range α1 to the second deflection range α2, and enters the surface of the photosensitive drum 13. Therefore, the incident light quantity distributions of the respective light fluxes La and Lb at the surface of the photosensitive drum 13 are substantially unbalanced.

Therefore, when a distance between the respective light-emitting points 82 and 83 in the height direction Z at the light-emitting surfaces 81 is adjusted by rotation of the light-emitting surface 81 of the second semiconductor laser 45*b*, rotation of the light-emitting surface 81 in the F2 direction is not preferable.

Next, the following describes the rotation direction of the light-emitting surface 81 of the first semiconductor laser 44*a*. Rotation of the light-emitting surface 81 of the second semiconductor laser 45*b* in the F1 direction allows reducing unbalance of incident light quantity distributions of the respective light fluxes La and Lb at the surface of the photosensitive drum 13. However, the light-emitting surface 81 of the first semiconductor laser 44*a* needs to be rotated in the reverse direction to the F1 direction.

This is because of the following reason. The first semiconductor laser 44*a*, the first incident optical system 51, and the first image-forming optical system 61 are symmetrically disposed to the second semiconductor laser 45*b*, the second incident optical system 52, and the second image-forming optical system 62 with respect to the imaginary arrangement center line M. Therefore, the polarization direction of the light flux L1 of the first semiconductor laser 44*a* becomes a reflected image to the polarization direction of the light flux L4 of the second semiconductor laser 45*b* with respect to the imaginary arrangement center line M.

The light flux L1 of the first semiconductor laser 44*a* is reflected by the reflecting surface 42*a* of the polygonal mirror 42, is deflected in the second deflection range α2 first, is superimposed with the imaginary deflection center line Q, and is again deflected in the first deflection range α1. Therefore, a scan direction of the light flux L1 on the surface of the photosensitive drum 13 and a scan direction of the light flux L4 on the surface of the photosensitive drum 13 become opposite direction to one another.

FIG. 13 is a diagram illustrating a rotation position of the light-emitting surface 81 of the first semiconductor laser 44*a*, the reflecting surface 42*a* of the polygonal mirror 42, a reflectance distribution at the reflecting surface 42*a* in the main-scanning direction X, the reflecting surface of the reflective mirror 64*a*, a reflectance distribution at the reflecting surface of the reflective mirror 64*a* in the main-scanning direction X, incident light quantity distributions at the surface of the photosensitive drum 13 in the main-scanning direction X, and similar items.

In (I) of FIG. 13, the light-emitting surface 81 is rotated in the F2 direction, which is the reverse direction to the F1 direction illustrated in (I) of the column B of FIG. 11, to incline the polarization directions of the respective light fluxes La and Lb emitted from the respective light-emitting points 82 and 83.

In this case, as illustrated in (II) of FIG. 13, the polarization directions J (the YZ directions) of the respective light fluxes La and Lb (the linear polarization) are inclined to the incident surface 92*a* (the XY plane) including the respective light fluxes La and Lb that enter and are reflected by the reflecting surface 42*a* of the polygonal mirror 42, and inclined to the opposite direction to the inclination direction of (II) in the column B of FIG. 11. The polarization directions J of the respective light fluxes La and Lb with respect to the reflecting surface 42*a* of the polygonal mirror 42 are directions of when the reflecting surface 42*a* of the polygonal mirror 42 is viewed from the first semiconductor laser 44*a* side.

As illustrated in (III) and (IV) of FIG. 13, when the respective light fluxes La and Lb are deflected in the second deflection range α2, as the respective light fluxes La and Lb approach the imaginary deflection center line Q, the angles of incidence and the reflection angles of the respective light fluxes La and Lb with respect to the reflecting surface 42*a* gradually decrease, and the reflectivities of the P polarized components of the respective light fluxes La and Lb gradually increase. Subsequently, in the case where the respective light fluxes La and Lb are on the imaginary deflection center line Q, the angles of incidence and the reflection angles of the respective light fluxes La and Lb with respect to the reflecting surface 42*a* smoothly change, and the reflectivities of the P polarized components of the respective light fluxes La and Lb also smoothly change. Further, when the respective light fluxes La and Lb are deflected in the first deflection range α1, as the respective light fluxes La and Lb become distant from the imaginary deflection center line Q, the angles of incidence and the reflection angles of the respective light fluxes La and Lb with respect to the reflecting surface 42*a* gradually decrease, and the reflectivities of the P polarized components of the respective light fluxes La and Lb gradually increase. Accordingly, the reflectivity of reflecting surface 42*a* gradually increases from the second deflection range α2 to the first deflection range α1, changing similarly to the reflectivity of (IV) in the column B of FIG. 11.

As illustrated in (V) of FIG. 13, any of in the second deflection range α2, on the imaginary deflection center line Q, and in the first deflection range α1, the polarization directions J (the YZ directions) of the respective light fluxes La and Lb are inclined to the same direction with respect to the incident surface 92*b* including the light flux La or Lb that enter and are reflected by the reflecting surface of the reflective mirror 64*a* and inclined to the opposite direction to the inclination direction of (V) in the column B of FIG. 11. The polarization directions J of the respective light fluxes La and Lb with respect to the reflecting surface of the reflective mirror 64*a* are directions of when the reflecting surface of the reflective mirror 64*a* is viewed from the polygonal mirror 42 side.

The light-emitting surface 81 is rotated in the F2 direction. Accordingly, the inclination angle of the polarization direction J with respect to the incident surface 92*b* when the respective light fluxes La and Lb are deflected in the second deflection range α2 becomes larger than the inclination angle of the polarization direction J with respect to the incident surface 92*b* when the respective light fluxes La and Lb are deflected in the first deflection range α1. When the respective light fluxes La and Lb are deflected in the second deflection range α2, as the respective light fluxes La and Lb approach the imaginary deflection center line Q, the inclination angle of the polarization direction J gradually decreases. Subsequently, in the case where the respective light fluxes La and Lb are on the imaginary deflection center line Q, the inclination angle of the polarization direction J smoothly changes. Further, when the respective light fluxes La and Lb are deflected in the first deflection range α1, as the respective light fluxes La and Lb become distant from the imaginary deflection center line Q, the inclination angle of the polarization direction J gradually further decreases. Accordingly, as illustrated in (VI) and (VII) of FIG. 13, the ratios of the P polarized components of the respective light fluxes La and Lb gradually increase from the second deflection range α2 to the first deflection range α1, and the ratios of the S polarized components of the respective light fluxes La and Lb gradually decrease. Therefore, reflectivity of the reflecting surface of the reflective mirror 64*a* gradually decreases from the second deflection range α2 to the first deflection range α1, changing similarly to the reflectivity of (VII) in the column B of FIG. 11.

Further, the reflecting surface 42*a* of the polygonal mirror 42 has a reflectance distribution illustrated in (IV) of FIG. 13. The reflecting surface of the reflective mirror 64*a* has a reflectance distribution illustrated in (VII) of FIG. 13. Accordingly, unbalance of these reflectance distributions are cancelled one another. In view of this, these respective light fluxes La and Lb are equivalent to the respective light fluxes La and Lb that are reflected by the imaginary reflecting surface with the reflectance distribution of approximately uniform illustrated in (VIII) of FIG. 13, which is a combination of these reflectance distributions (IV) and (VII), and enter the surface of the photosensitive drum 13. Therefore, the incident light quantity distributions of the respective light fluxes La and Lb at the surface of the photosensitive drum 13 are also approximately uniform.

Thus, rotation of the light-emitting surface 81 of the first semiconductor laser 44*a* in the F2 direction allows unbalance of the reflectance distribution at the reflecting surface 42*a* of the polygonal mirror 42 and unbalance of the reflectance distribution at the reflecting surface of the reflective mirror 64*a* to be cancelled one another. Thus, the incident light quantity distributions of the respective light fluxes La and Lb at the surface of the photosensitive drum 13 become approximately uniform.

The light-emitting surface 81 of the second semiconductor laser 45*b* is rotated in the F1 direction and the light-emitting surface 81 of the first semiconductor laser 44*a* is rotated in the F2 direction, which is the reverse direction to the F1 direction. Accordingly, the polarization directions of the respective light fluxes La and Lb in linear polarization of the second semiconductor laser 45*b* are set symmetrical to the polarization directions of the respective light fluxes La and Lb in linear polarization of the first semiconductor laser 44*a* with respect to a rotation axis of the polygonal mirror 42 with one another.

Next, the following describes the rotation direction of the light-emitting surface 81 of the second semiconductor laser 45*a*. The light flux L3 of the second semiconductor laser 45*a* is reflected by the reflecting surface 42*a* of the polygonal mirror 42, subsequently is reflected by the three reflective mirrors 66*b*, 66*c*, and 66*d*, and enters the surface of the photosensitive drum 13. Accordingly, the light flux L3 of the second semiconductor laser 45*a* is reflected by more reflective mirrors than the light flux L4 of the second semiconductor laser 45*b*.

However, the light flux L3 of the second semiconductor laser 45*a* is reflected by the reflective mirror 66*b* in the height direction Z, and subsequently is reflected by the two reflective mirrors 66*c* and 66*d* in the sub-scanning direction Y or the height direction Z. Accordingly, incident surfaces separately defined to the respective reflective mirrors 66*b*, 66*c*, and 66*d* become almost YZ plane. Inclination of the polarization direction of the light flux L3 (the respective light fluxes La and Lb) with respect to these incident surfaces almost matches inclination of the polarization direction of the light flux L4 (the respective light fluxes La and Lb) with respect to the incident surface 92*b* defined to the reflective mirror 66*a*. In view of this, rotation of the light-emitting surface 81 of the second semiconductor laser 45*a* in the F1 direction gradually increases reflectivities of the respective reflective mirrors 66*b*, 66*c*, and 66*d* from the first deflection range α1 to the second deflection range α2 almost similarly to the reflectivity of the reflective mirror 66*a*. Therefore, to adjust a distance between the respective light-emitting points 82 and 83 of the light-emitting surface 81 of the second semiconductor laser 45*a* in the height direction Z, rotation of the light-emitting surface 81 of the second semiconductor laser 45*a* in the F1 direction allows reducing unbalance of incident light quantity distributions of the respective light fluxes La and Lb at the surface of the photosensitive drum 13.

Due to similar reason, regarding the rotation direction of the light-emitting surface 81 of the first semiconductor laser 44*b*, the light flux L2 of the first semiconductor laser 44*b* is reflected by three reflective mirrors 64*b*, 64*c*, and 64*d*. However, rotation of the light-emitting surface 81 of the first semiconductor laser 44*b* in the F2 direction gradually reduces reflectivities of the respective reflective mirrors 64*b*, 64*c*, and 64*d* from the second deflection range α2 to the first deflection range α1 almost similarly to the reflectivity of the reflective mirror 64*a*. In view of this, rotation of the light-emitting surface 81 of the first semiconductor laser 44*b* in the F2 direction allows reducing unbalance of incident light quantity distributions of the respective light fluxes La and Lb at the surface of the photosensitive drum 13.

Therefore, the rotation direction of the light-emitting surface 81 of the first semiconductor laser 44*b* and the rotation direction of the second semiconductor laser 45*a* become an opposite direction to one another. The polarization directions of the respective light fluxes La and Lb in linear polarization of the first semiconductor laser 44*a* are set symmetrical to the polarization directions of the respective light fluxes La and Lb in linear polarization of the second semiconductor laser 45*b* with respect to the rotation axis of the polygonal mirror 42 with one another.

Figure 14:
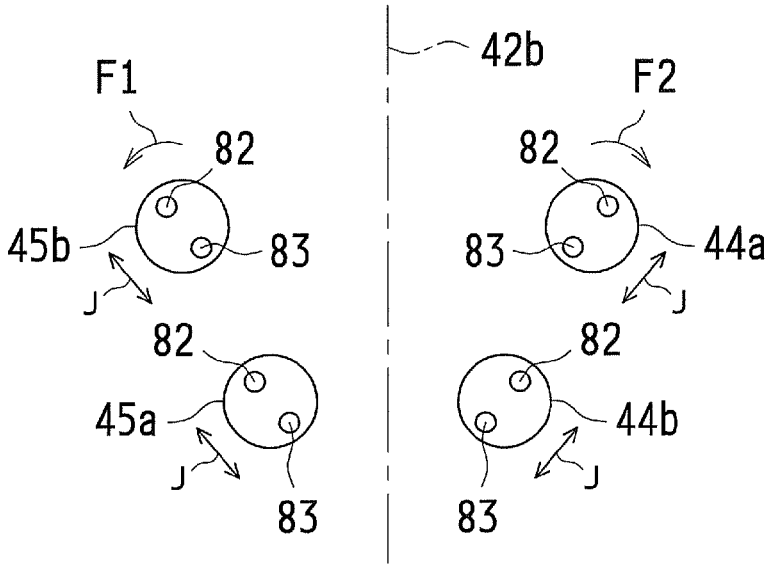
FIG. 14 is a plan view schematically illustrating a polarization direction of the light fluxes of respective semiconductor lasers.

FIG. 14 is a plan view schematically illustrating the polarization directions of the respective light fluxes La and Lb in linear polarization emitted from each of the first semiconductor lasers 44*a* and 44*b* and the polarization directions of the respective light fluxes La and Lb in linear polarization emitted from each of the second semiconductor lasers 45*a* and 45*b* of the first and the second embodiments. As apparent from FIG. 14, the respective first semiconductor lasers 44*a* and 44*b* and the respective second semiconductor lasers 45*a* and 45*b* are positioned at the respective apexes of the trapezoid. The light-emitting surfaces 81 of the respective first semiconductor lasers 44*a* and 44*b* are rotated in the F2 direction. The light-emitting surfaces 81 of the respective second semiconductor lasers 45*a* and 45*b* are rotated in the F1 direction. The polarization direction J of the total of four light fluxes La and Lb emitted from the respective first semiconductor lasers 44*a* and 44*b* is set symmetrical to the polarization direction J of the total of four light fluxes La and Lb emitted from the respective second semiconductor lasers 45*a* and 45*b* with respect to a rotation axis 42*b* of the polygonal mirror 42.

Figure 15:
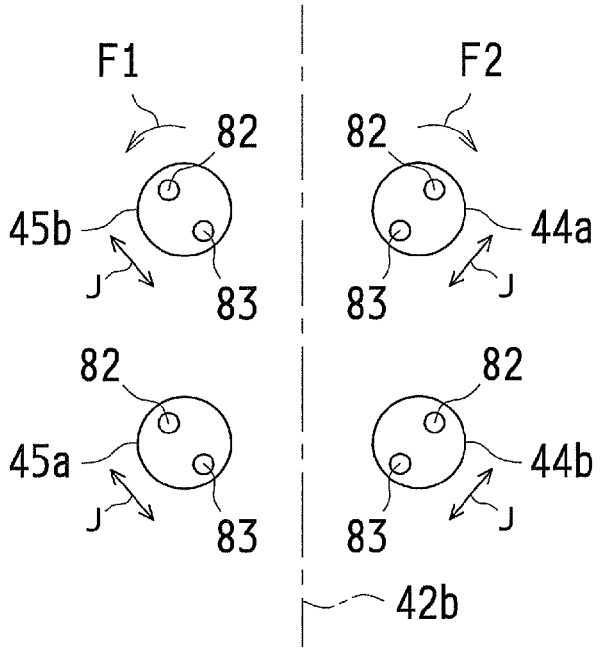
FIG. 15 is a plan view schematically illustrating modification of a polarization direction of the light fluxes of respective semiconductor lasers of a third embodiment.

The first semiconductor lasers 44*a* and 44*b* and the second semiconductor lasers 45*a* and 45*b* of the light scanning device 11 are positioned at respective apexes of trapezoid. However, the arranged positions may be changed. For example, the third embodiment illustrated in FIG. 15 disposes the first semiconductor lasers 44*a* and 44*b* and the second semiconductor lasers 45*a* and 45*b* at the respective apex positions of rectangle. In this case as well, the rotation direction of the light-emitting surfaces 81 of the respective first semiconductor lasers 44*a* and 44*b* and the rotation direction of the light-emitting surfaces 81 of the respective second semiconductor lasers 45*a* and 45*b* become the opposite directions to one another. The polarization direction J of the total of four light fluxes La and Lb emitted from the respective first semiconductor lasers 44*a* and 44*b* is set symmetrical to the polarization direction J of the total of four light fluxes La and Lb emitted from the respective second semiconductor lasers 45*a* and 45*b* with respect to the rotation axis 42*b* of the polygonal mirror 42 with one another.

In the light scanning device 11, the first semiconductor lasers 44*a* and 44*b*, the first incident optical system 51, and the first image-forming optical system 61 are symmetrically disposed to the second semiconductor lasers 45*a* and 45*b*, the second incident optical system 52, and the second image-forming optical system 62 with respect to the imaginary arrangement center line M. However, the present invention is applicable to even a light scanning device with another constitution as long as the light scanning device includes a light-emitting element that emits light flux including a linear polarization component. The light scanning device 11 includes the respective first semiconductor lasers 44*a* and 44*b* and the respective second semiconductor lasers 45*a* and 45*b* corresponding to the respective colors for color images. However, the present invention is applicable to even a light scanning device with at least one light-emitting element corresponding to monochrome.

Further, the first to the third embodiments describe an example of semiconductor laser that emits two light fluxes with the same polarization direction. However, the present invention is applicable to even a light scanning device applying semiconductor laser that emits equal to or more than three light fluxes with same polarization direction. In one semiconductor laser, insofar as the polarization directions of the respective light fluxes are the same, the respective light-emitting points from which the respective light fluxes are emitted may not be linearly arranged.

The preferred embodiments and modification according to the present invention is described above with reference to the attached drawings; however, it is needless to say that the present invention is not limited to the above examples. It would be obvious that an ordinary skilled person conceives various modifications and corrections within scopes defined in the claims, and it should be understood that those modified examples fall within the technical scope of the present invention.

DESCRIPTION OF REFERENCE SIGNS

1 image forming apparatus
11 light scanning device
12 developing equipment
13 photosensitive drum (scan object)
14 drum cleaning apparatus
15 charging apparatus
17 fixing apparatus
21 intermediate transfer belt
22 belt cleaning apparatus
23 secondary transfer apparatus
33 pickup roller
34 registration roller
35 conveyance roller
36 discharge roller
41 housing
42 polygonal mirror (deflecting part)
43 polygonal motor
44*a*, 44*b* first semiconductor laser (light-emitting element)
45*a*, 45*b* second semiconductor laser (light-emitting element)
46 drive substrate
51 first incident optical system
52 second incident optical system

53*a*, 53*b*, 57*a*, 57*b* collimator lens
55*a*, 55*b*, 59*a*, 59*b* mirror
56 cylindrical lens
61 first image-forming optical system
62 second image-forming optical system
63, 65 fθ lens
64*a* to 64*d*, 66*a* to 66*d* reflective mirror
71, 74 BD mirror
72, 75 BD sensor

The invention claimed is:

1. A light scanning device, comprising:

a light-emitting element with a plurality of light-emitting points, respective light fluxes being emitted from the plurality of light-emitting points;

a deflecting part configured to reflect to deflect the respective light fluxes; and a reflective mirror configured to reflect the respective light fluxes reflected to be deflected by the deflecting part; wherein the light scanning device is configured to scan a scan object with the respective light fluxes passing through the deflecting part and the reflective mirror, a continuous scan deflection range of each of the light fluxes deflected by the deflecting part in a scan period of the scan object with the respective light fluxes is divided into a first deflection range where a reflection angle of each of the light fluxes with respect to the deflecting part is small and a second deflection range where the reflection angle is large, the second deflection range being adjacent to the first deflection range, a polarization direction of each of the light fluxes is set such that a reflectivity of the reflective mirror when each of the light fluxes deflected in the second deflection range is reflected becomes larger than a reflectivity of the reflective mirror when each of the light fluxes deflected in the first deflection range is reflected, and a rotation of the light-emitting element inclines an arranging direction of respective light-emitting points of the light-emitting element with respect to the rotation axis of the deflecting part, the inclination setting an incident interval of the light fluxes from the respective light-emitting points on the scan object.

2. The light scanning device according to claim 1, wherein the light flux that enters the reflective mirror and the light flux reflected by the reflective mirror form an obtuse angle.

3. The light scanning device according to claim 2, wherein a reflection angle of the light flux with respect to the reflective mirror is more than 45° and less than 90°.

4. The light scanning device according to claim 1, wherein the light fluxes at respective light-emitting points of the light-emitting element have a same polarization direction.

5. The light scanning device according to claim 1, wherein the incident interval of the light fluxes from the respective light-emitting points is an interval in a direction perpendicular to the polarization direction of the respective light fluxes on the scan object.

6. The light scanning device according to claim 1, wherein a reflection angle of each of the light fluxes with respect to the deflecting part varies in a range of 10° to 60°.

7. The light scanning device according to claim 1, wherein a reflectivity of the deflecting part when each of the light fluxes is reflected to the second deflection range is smaller than a reflectivity of the deflecting part when each of the light fluxes is reflected to the first deflection range.

8. An image forming apparatus, comprising the light scanning device according to claim 1, wherein the light scanning device forms a latent image on a scan object, the latent image on the scan object being developed into a visible image, the visible image being transferred from the scan object to be formed on a paper sheet.

9. A light scanning device, comprising:

a first light-emitting element and a second light-emitting element, with a plurality of light-emitting points, respective light fluxes being emitted from the plurality of light-emitting points;

a deflecting part configured to reflect to deflect the respective light fluxes emitted from the first light-emitting element and the second light-emitting element; and respective reflective mirrors configured to reflect the respective light fluxes reflected to be deflected by the deflecting part; wherein the first light-emitting element and one of the respective reflective mirrors, and the second light-emitting element and another of the respective reflective mirrors are divided to both sides of an imaginary arrangement center line passing through a rotation axis of the deflecting part, and the light scanning device is configured to scan a scan object with the respective light fluxes passing through the deflecting part and the respective reflective mirrors, a continuous scan deflection range of each of the light fluxes deflected by the deflecting part in a scan period of the scan object with the respective light fluxes is divided into a first deflection range where a reflection angle of each of the light fluxes with respect to the deflecting part is small and a second deflection range where the reflection angle is large for each of the reflective mirrors separately, the second deflection range being adjacent to the first deflection range, a polarization direction of each of the light fluxes emitted from the first light-emitting element and a polarization direction of each of the light fluxes emitted from the second light-emitting element are set to be symmetrical to one another with respect to a rotation axis of the deflecting part such that a reflectivity of the reflective mirror when each of the light fluxes deflected in the second deflection range is reflected becomes larger than a reflectivity of the reflective mirror when each of the light fluxes deflected in the first deflection range is reflected in any of the respective reflective mirrors, and a rotation of at least one of the first and the second light-emitting elements inclines an arranging direction of respective light-emitting points of the at least one with respect to the rotation axis of the deflecting part, the inclination setting an incident interval of the light fluxes from the respective light-emitting points of the at least one on the scan object.

10. The light scanning device according to claim 9, wherein the polarization direction of each of the light fluxes emitted from the first light-emitting element and the polarization direction of each of the light fluxes emitted from the second light-emitting element are inclined to reverse directions to one another with respect to the rotation axis of the deflecting part.

11. The light scanning device according to claim 9, wherein the light fluxes of the first light-emitting element at respective light-emitting points have a same polarization direction, and the light fluxes of the second light-emitting element at the respective light-emitting points have a same polarization direction.

12. The light scanning device according to claim 9, wherein the first light-emitting element and the second light-emitting element are disposed by two for each, the first light-emitting element and the second light-emitting element being disposed at respective apexes of a trapezoid or a rectangle on a plane perpendicular to emission direction of light flux of the respective first light-emitting element and emission direction of light flux of the respective second light-emitting element.

* * * * *